US010342295B2

(12) United States Patent
Krikorian et al.

(10) Patent No.: US 10,342,295 B2
(45) Date of Patent: Jul. 9, 2019

(54) REPLACEABLE TRACTION CLEAT FOR FOOTWEAR

(71) Applicant: Pride Manufacturing Company, LLC, Brentwood, TN (US)

(72) Inventors: Rand J. Krikorian, Brentwood, TN (US); John Robert Burt, Chandler, AZ (US)

(73) Assignee: PRIDE MANUFACTURING COMPANY, LLC, Brentwood, TN (US)

( * ) Notice: Subject to any disclaimer, the term of this patent is extended or adjusted under 35 U.S.C. 154(b) by 266 days.

(21) Appl. No.: 15/590,185

(22) Filed: May 9, 2017

(65) Prior Publication Data

US 2017/0245597 A1 Aug. 31, 2017

Related U.S. Application Data

(62) Division of application No. 14/136,075, filed on Dec. 20, 2013, now abandoned, which is a division of application No. 12/695,332, filed on Jan. 28, 2010, now Pat. No. 8,631,591.

(60) Provisional application No. 61/148,022, filed on Jan. 28, 2009.

(51) Int. Cl.

| | |
|---|---|
| ***A43C 15/00*** | (2006.01) |
| ***A43C 15/16*** | (2006.01) |
| ***A43B 5/00*** | (2006.01) |

(52) U.S. Cl.

CPC ..... *A43C 15/168* (2013.01); *A43B 5/00* (2013.01); *A43C 15/16* (2013.01); *A43C 15/161* (2013.01); *A43C 15/162* (2013.01)

(58) Field of Classification Search

CPC ..... A43C 15/00; A43C 15/02; A43C 15/16; A43C 15/161; A43C 15/162; A43C 15/164; A43C 15/165; A43C 15/167; A43C 15/168

USPC ..... 36/59 R, 67 A, 67 D, 134, 135

See application file for complete search history.

(56) References Cited

U.S. PATENT DOCUMENTS

| | | | | |
|---|---|---|---|---|
| 4,698,923 | A | 10/1987 | Arff | |
| 4,914,838 | A | 4/1990 | Ihlenburg | |
| 5,906,059 | A * | 5/1999 | Singer | A43C 15/16 36/134 |
| 5,974,700 | A | 11/1999 | Kelly | |
| 6,052,923 | A | 4/2000 | McMullin | |
| 6,209,230 | B1 | 4/2001 | Curley | |
| 6,272,774 | B1 * | 8/2001 | Kelly | A43B 5/001 36/134 |
| 6,305,104 | B1 | 10/2001 | McMullin | |
| 6,354,021 | B1 | 3/2002 | Deacon | |

(Continued)

*Primary Examiner* — Jameson D Collier

(74) *Attorney, Agent, or Firm* — Edell, Shapiro & Finnan, LLC

(57) ABSTRACT

Adjustable traction is provided in a traction cleat by selectively restricting or not the amount of flexure permitted for a dynamic traction element on the cleat. Restricting flexure is alternatively achieved by an adjustably positionable ring or by rotating the cleat to align the dynamic element with different shoe sole topographical features. A dual locking post is provided to reduce the surface area required on the cleat hub for locking structures. The cleat is formed in a two shot molding process that permits elongations of the dynamic traction elements without sacrificing the integrity of the cleat structure.

11 Claims, 26 Drawing Sheets

(56) References Cited

U.S. PATENT DOCUMENTS

| | | | | |
|---|---|---|---|---|
| 6,631,571 | B2 | 10/2003 | McMullin | |
| 6,823,613 | B2 | 11/2004 | Kelly | |
| 6,834,446 | B2 | 12/2004 | McMullin | |
| 7,040,043 | B2 | 5/2006 | McMullin | |
| RE40,460 | E | 8/2008 | Savoie | |
| 7,412,784 | B1 | 8/2008 | Bobbett | |
| 7,559,160 | B2 | 7/2009 | Kelly | |
| 2001/0011429 | A1* | 8/2001 | Peabody | A43B 5/001 36/134 |
| 2002/0078603 | A1 | 6/2002 | Schmitt | |
| 2003/0188458 | A1 | 10/2003 | Kelly | |
| 2003/0188459 | A1* | 10/2003 | Kelly | A43B 5/001 36/134 |
| 2004/0010944 | A1 | 1/2004 | McMullin | |
| 2006/0130372 | A1 | 6/2006 | Auger et al. | |
| 2006/0277800 | A1 | 12/2006 | Santos et al. | |
| 2007/0209239 | A1 | 9/2007 | Kelly | |
| 2008/0072459 | A1 | 3/2008 | Robinson | |
| 2008/0196276 | A1 | 8/2008 | McMullin | |
| 2009/0223088 | A1 | 9/2009 | Krikorian | |
| 2010/0257751 | A1 | 10/2010 | Burt | |
| 2016/0178804 | A1 | 7/2016 | Burt | |

* cited by examiner

REPLACEABLE TRACTION CLEAT FOR FOOTWEAR

This application is a divisional of U.S. patent application Ser. No. 14/136,075, filed Dec. 20, 2013, which is a divisional application of U.S. application Ser. No. 12/695,332, filed Jan. 28, 2010, which claims the benefit of U.S. Provisional Patent Application No. 61/148,022, entitled "Improved Replaceable Traction Cleat and Method of Connection" and filed Jan. 28, 2009, all of which are incorporated herein by reference in their entireties.

BACKGROUND OF THE INVENTION

Technical Field

The present invention pertains to athletic footwear and, more particularly to athletic shoes and traction cleats for providing improved traction and comfort for the wearer of an athletic shoe. In addition, the present invention pertains to methods and apparatus for providing adjustability of the traction and comfort afforded by a cleat for a shoe, and for improving the mechanism and method for locking replaceable traction cleats in place in a receptacle mounted in the outsole of a shoe. Further, the invention relates to improving dynamic traction without sacrificing the structural integrity of a cleat.

Although the preferred embodiments of the present invention are described in connection with golf shoes and cleats for golf shoes, it is to be understood that the principles of the invention apply to any shoe on which cleats or similar traction-providing devices are utilized.

Discussion of State of the Art

Historically, golf shoes were provided with traction by means of sharp metal spikes that dig into turf. After many years it was realized that these metal spikes damage the root structure of grass on golf courses, particularly on greens, and as a result, plastic cleat structures were developed so as not to damage grass blades and roots. An early example of such a cleat is found in U.S. Pat. No. 6,354,021 (Deacon et al). A refinement of the plastic traction cleat concept appears in U.S. Pat. No. 6,052,923 (McMullin '923), the disclosure in which is incorporated herein by reference in its entirety. In McMullin '923 there is disclosed a cleat having a hub with a threaded stem projecting from its upper surface to threadedly engage a receptacle mounted in the outsole of a shoe. The underside of the hub has plural relatively short traction protrusions, each having a height sufficient to engage blades of grass in turf to provide traction without puncturing the turf. Subsequent developments increased the length and cross section of these plastic but relatively hard traction elements.

The next major development in the art of plastic traction cleats was dynamic traction elements. Specifically, as part of the dynamic traction concept, the underside of the cleat hub is provided with somewhat longer dynamic traction elements that are secured to and project downwardly and outwardly from the hub and flex to spread outwardly under the load of the weight of a wearer of the shoe to effect traction and a cushiony "feel" for the wearer. The cushiony "feel" results from the gradual spreading outwardly of the flexing traction elements as the sole of the shoe is forced against the turf or ground providing a feeling of resilience to the wearer. Examples of cleats that incorporate dynamic traction elements are found in U.S. Pat. No. 6,209,230 (Curley '230), U.S. Pat. No. 6,305,104 (McMullin '104) and U.S. Pat. No. 7,040,043 (McMullin '043); the disclosures in these patents are incorporated herein by reference in their entireties. These cleats are typically secured to a threaded shoe receptacle or connector mounted in the shoe sole by means of a correspondingly threaded stem extending upwardly from the hub.

Cleats having a combination of both flexible (i.e. dynamic) and relatively inflexible (i.e., static) traction elements are also known in the art. See, for example, U.S. Pat. No. 6,834,446 (McMullin '446), the disclosure in which is incorporated herein by reference in its entirety. In operation, under the increasing weight of the wearer of a golf shoe during a walking step, the longer dynamic elements make initial contact with the turf and spread while deflecting toward the shoe sole. The static traction elements are configured to resist deflection when engaging the ground surface and to provide a suitable bearing for supporting weight applied through the shoe sole. The dynamic and static elements may be arranged in alternation around the hub periphery or in any symmetrical or asymmetrical array, depending on the intended static characteristics. If an asymmetrical array is used, it is known from U.S. Pat. No. 6,823,613 (Kelly et al '613) to design the threaded stem, or other connecting member on the cleat, and the threaded receptacle, or other mating connector in the shoe outsole, in a cooperative manner such that the cleat has only one specific rotational orientation relative to the outsole, whereby the positions of the static and dynamic traction elements are predetermined. The disclosure in the Kelly et al '613 patent is incorporated herein in its entirety.

Some golfers prefer the cushiony feel of dynamic traction elements while others prefer the harder feel of static traction elements. In many cases, differences in terrain and the turf can dictate the need for a harder or softer feel and for the nature of the required traction, (i.e., whether static or dynamic or some intermediate therebetween). We have realized, therefore, that there is a need for a shoe and cleat that permits the wearer to select between harder or more cushiony "feels", and between different levels of dynamic or static traction.

It is also known in the prior art to provide a locking mechanism associated with the connection of the cleat to the shoe-mounted connector to prevent inadvertent loosening of the connection and removal of the cleat. Examples of such locking mechanisms are found in Kelly et al '613 as well as U.S. Pat. No. 5,974,700 (Kelly '700) and U.S. Pat. No. 7,107,708 (Kelly et al '708), and in U.S. Patent Application Publication No. 2007/0209239 Kelly et al '239) and the disclosures from these patents and published application are also incorporated herein by reference in their entireties. Among these locking mechanisms is one sold under the trademark FAST TWIST® comprising radially facing locking formations on the cleat and receptacle, respectively, operative to inter-engage when the stem has been screwed or otherwise rotatably engaged into the receptacle socket of the shoe-mounted connector. The locking formations on the outer wall of the internally threaded receptacle comprise an annular array of radially outward tooth-like projections, while the locking formations on the cleat include an angularly extending lead-in ramp, a recess and stop member. The tooth-like projection, during stem rotation, forcefully rides over a lead-in ramp before snapping into a recess, and then abuts the stop member to prevent the cleat from being screwed any further into the receptacle socket. The locking mechanisms allow the cleat to be unscrewed for removal and replacement upon exertion of a predetermined level of torque (i.e., typically by means of a special tool) by resilient yielding of the locking formations. The projections and lead-in ramps are typically formed on angularly-spaced, axially-extending webs surrounding the threaded stem and socket. The projection of one locking assembly may have a greater axial extent than the others, with a corresponding lead-in ramp of smaller axial extent. If this projection engages one of the other ramps, it will hold the threads of the stem and socket out of engagement, thereby preventing insertion of the threads at the wrong initial position.

There are several removable cleats being commercialized that utilize both the FAST TWIST® attachment mechanism and dynamic and/or static traction elements. Typically, these cleats utilize a molded first shot base which includes a body member or hub having, on its upper surface, a threaded stem form and a circular array of locking posts angularly spaced and uniformly arranged about a circular hub. Additional polymer material is molded (i.e., a second shot) on the lower surface of the hub to provide the dynamic or static traction elements or legs that extend downwardly and outwardly from the circular hub. The dynamic traction legs, depending of factors such as their length and flexibility, provide traction by: 1) tangling with grass; 2) deflecting upwardly toward the outsole of the shoe and trapping grass between the upper surface of the traction leg and the sole of the shoe; and/or 3) when the shoe slips sideways, absorbing or opposing the force of the lateral slip and folding inwardly toward the cleat axis, whereby the downward or vertical extension of the elements resiliently increases from the extension in the unflexed position.

Conventionally, the requirement that the dynamic traction elements extend from the periphery of the circular hub serves to restrict the downward or vertical extension that the traction element can achieve when providing traction against lateral slip. The present inventors are aware of an effort to mold dynamic legs or elements separately and then secure them to the hub by other than molding the hub and legs as an integral unit. This method, in theory, could allow the dynamic elements to be attached closer to the center of the cleat hub, thereby moving the element flexure point during lateral slip from the hub periphery to a location closer to the hub central axis. As a result, for the same overall height or vertical dimension of a cleat, the dynamic traction elements can be made longer from their proximal ends (i.e., the points of attachment to the hub) to their distal tips. The longer the lengths the dynamic traction elements, the greater is their ability to flex inward toward the axis and extend to provide increased traction during lateral slip. However, the method of separately molding the dynamic elements (as a unit) and then attaching them to the hub by means of a pin, or the like, is both costly and suffers from the possibility of the element unit becoming detached from the hub. In another aspect of the present invention we present a solution to that problem.

Another limitation in the design of prior dynamic traction cleats is the need to provide a substantially solid circular hub in order to accommodate the above described FAST TWIST® locking mechanism. More specifically, the typically six FAST TWIST® locking posts disposed on the cleat hub are required to be equi-angularly spaced in a continuous array about the threaded stem in order to function in concert with the teeth on the FAST TWIST® shoe-mounted receptacle. If the hub can be configured to require less material it would reduce the cost of manufacture. A feature of the present invention addresses this issue.

SUMMARY OF THE INVENTION

In accordance with one aspect of the present invention, the FAST TWIST® type of connector system is modified to facilitate the connection procedure, minimize the amount of material required on the cleat hub, and provide greater flexure space for dynamic traction elements. The six/twelve individual locking posts on the prior cleat are replaced with four dual locking structures, each comprising an inward facing surface forming two post sections positioned in an angularly symmetrical manner about a central recess disposed between them. Each post section includes interior and exterior ramp segments. The recess is configured to receive and retain a respective tooth of the receptacle that passes along an exterior ramp segment and then into the recess during connection of the cleat to the receptacle. The two interior ramp segments converge to form the centered recess, and the exterior segments diverge and terminate at respective ends of the dual post structure. The interior and exterior ramp segments of each post section converge inwardly and intersect to form an apex which is preferably rounded. The slope of the interior ramp segments is steeper than the slope of the exterior segments and, as a result, as the cleat is rotated into engagement with the receptacle, the teeth slide and force their way relatively easily along the more shallow slope of an exterior segment. However, once passing the apex and snapping into the recess, the teeth must pass the more steeply sloped interior ramp segments to move further relative to the dual post structure, and can do so only with the exertion of greater torque, thus enhancing the locking force opposing removal of the cleat from the receptacle.

In accordance with another aspect of the present invention, the traction and feel of a cleat is adjustable. In one version of this aspect of the invention a cleat includes three parts, a base, a dynamic traction part and a separable adjustment ring that has angularly spaced projections or blocking members. The adjustability is effected by selectively positioning the ring such that the blocking members are in or out of angular alignment with the dynamic traction elements to limit or not the degree of permitted dynamic element flexure. Alternatively, instead of a separate adjustment ring, blocking members or recesses can be disposed as topographical features on the receptacle or the outsole of the shoe, and the rotational position of the cleat permits the dynamic traction elements to be selectively aligned or not with the blocking members, recesses or no topographical variation in the outsole surface. With either approach, the blocking members can be of different heights to provide selective amounts of flexure dependent on the rotational position of the ring or the cleat. This aspect of the invention may thus be broadly viewed as providing adjustable traction in an athletic shoe dynamic traction cleat by selectively adjusting the amount of flexure permitted for said dynamic traction element.

In accordance with still another aspect of the present invention, the dynamic traction elements of the cleat of the present invention do not originate from the periphery of the cleat hub as in prior art dynamic cleats. Rather, the dynamic elements are part of a second shot dynamic traction portion of the molded cleat and have their roots or proximal ends originating further inboard, toward the hub central longitudinal axis, than at the hub periphery. The two-shot molding process forms an integral cleat comprising two chemically and mechanically bonded portions, namely a base portion including the cleat hub, a connector, locking members and static traction elements, and a softer more flexible dynamic traction portion including dynamic traction elements. As a result, the dynamic elements are integrally bonded to the base portion and are longer than in prior art cleats dynamic cleats, thereby adding to the flexure travel distance without sacrificing the structural integrity of the cleat.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein. It is to be understood that terms such as "first", "second", "left", "right" "top", "bottom", "vertical", horizontal", "front", "rear", "side", "height", "length", "width", "upper", "lower", "interior", "exterior", "inner", "outer" and the like as may be used herein, merely describe points of reference and do not limit the present invention to any particular orientation or configuration.

DESCRIPTION OF THE PREFERRED EMBODIMENTS

The following detailed explanations of the drawings and of the preferred embodiments reveal the methods and apparatus of the present invention.

Figure 1:
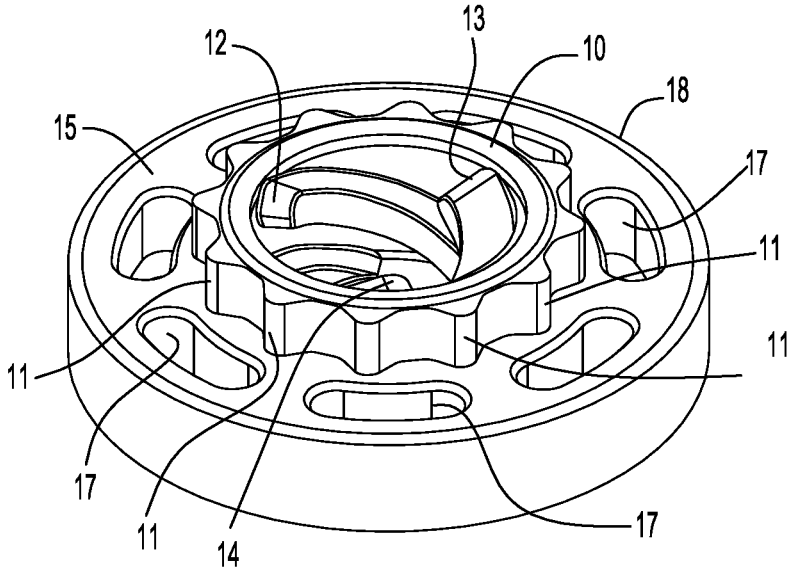
FIG. 1 is a bottom view in perspective of a FAST TWIST® receptacle with which the cleats of the present invention may be utilized.
Figure 2:
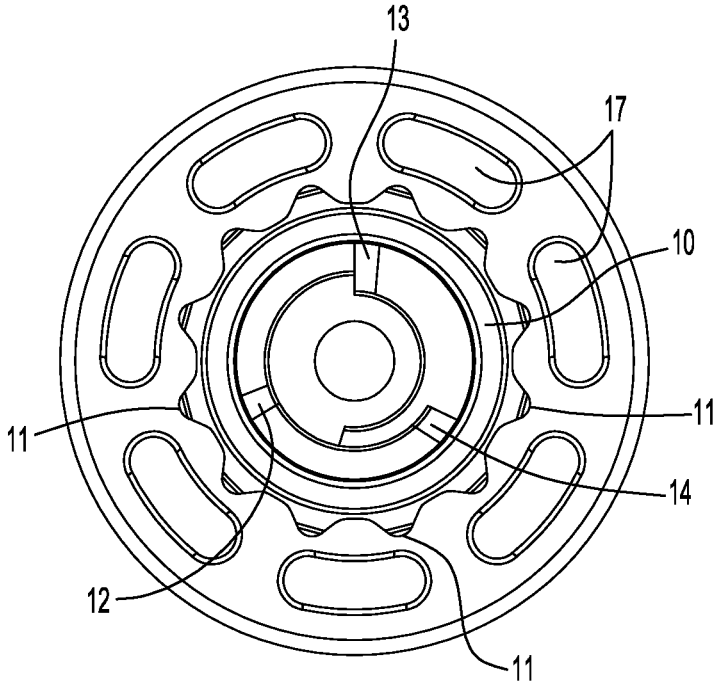
FIG. 2 is a bottom view in plan of the receptacle of FIG. 1.
Figure 3:
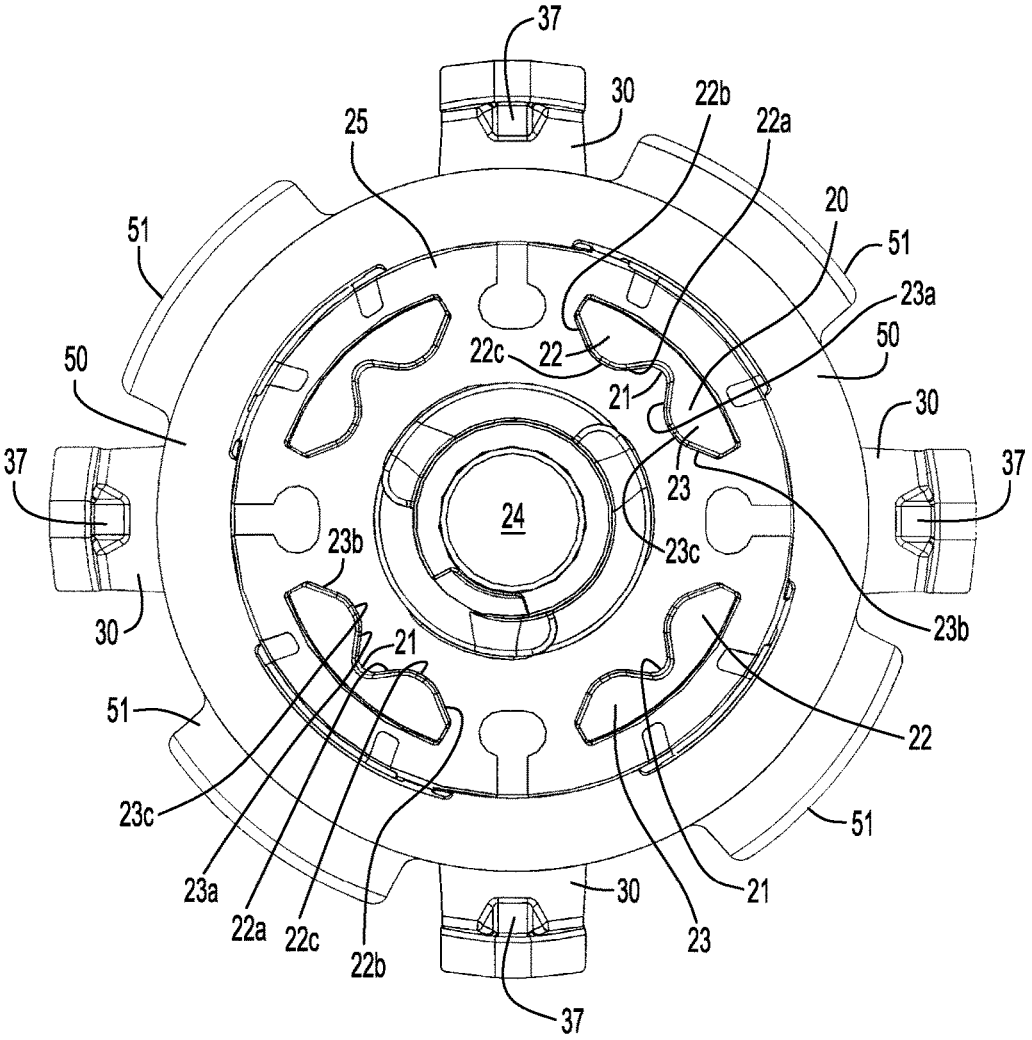
FIG. 3 is a top view in plan of a cleat according to a one preferred embodiment of the present invention showing the cleat base portion, dynamic traction portion and adjustment ring and with the adjustment ring shown in the parked position.
Figure 4:
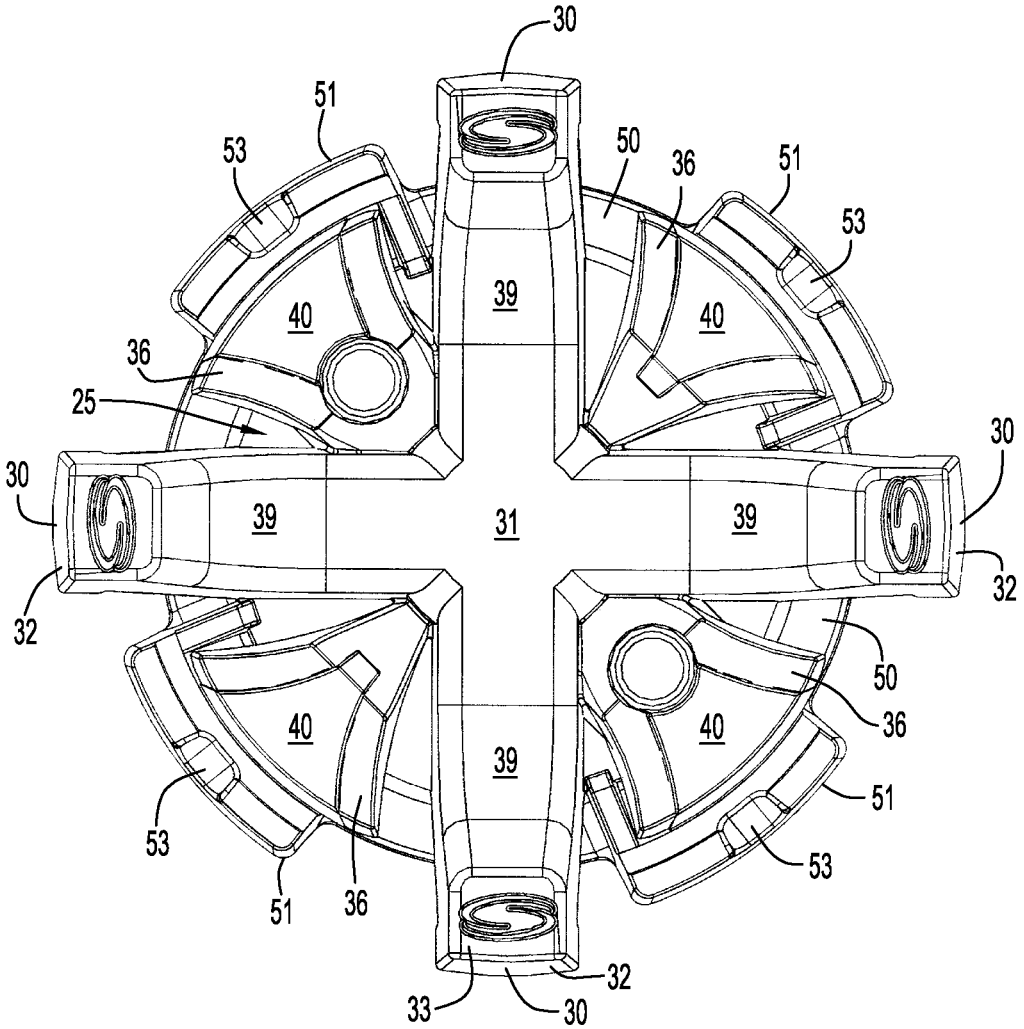
FIG. 4 is a bottom view in plan of the cleat of FIG. 3
Figure 5:
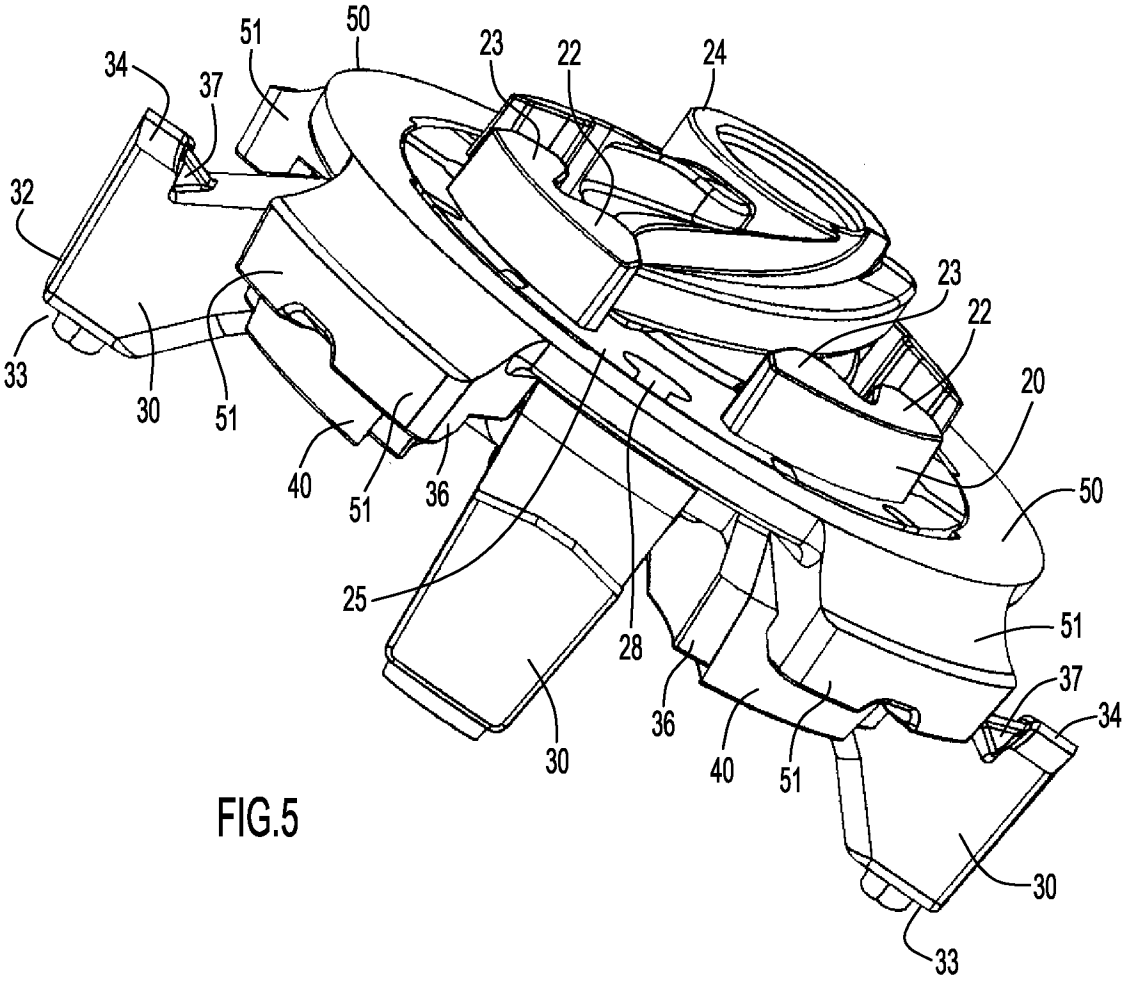
FIG. 5 is a top view in perspective of the cleat of FIG. 3.
Figure 6:
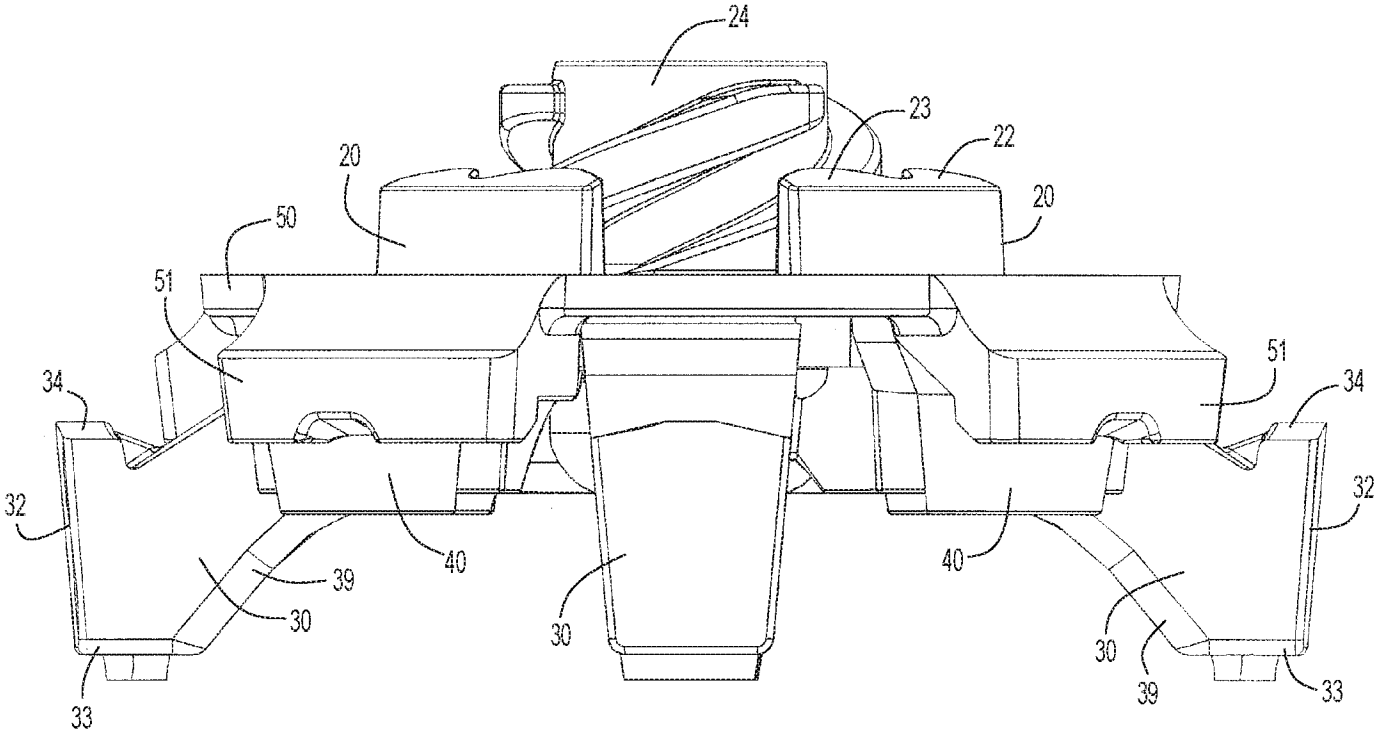
FIG. 6 is a side view in elevation of the cleat of FIG. 3.
Figure 7:
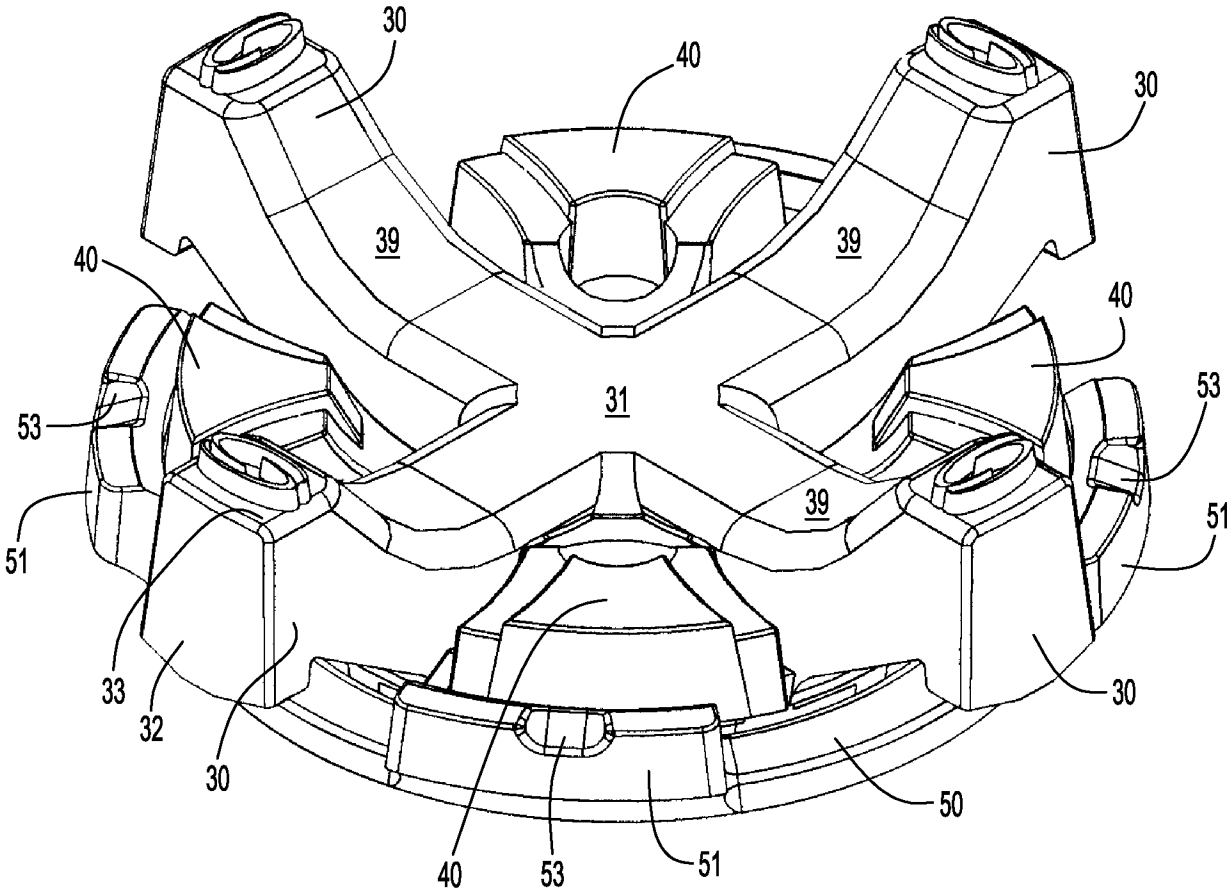
FIG. 7 is a is bottom view in perspective of the cleat of FIG. 3
Figure 8:
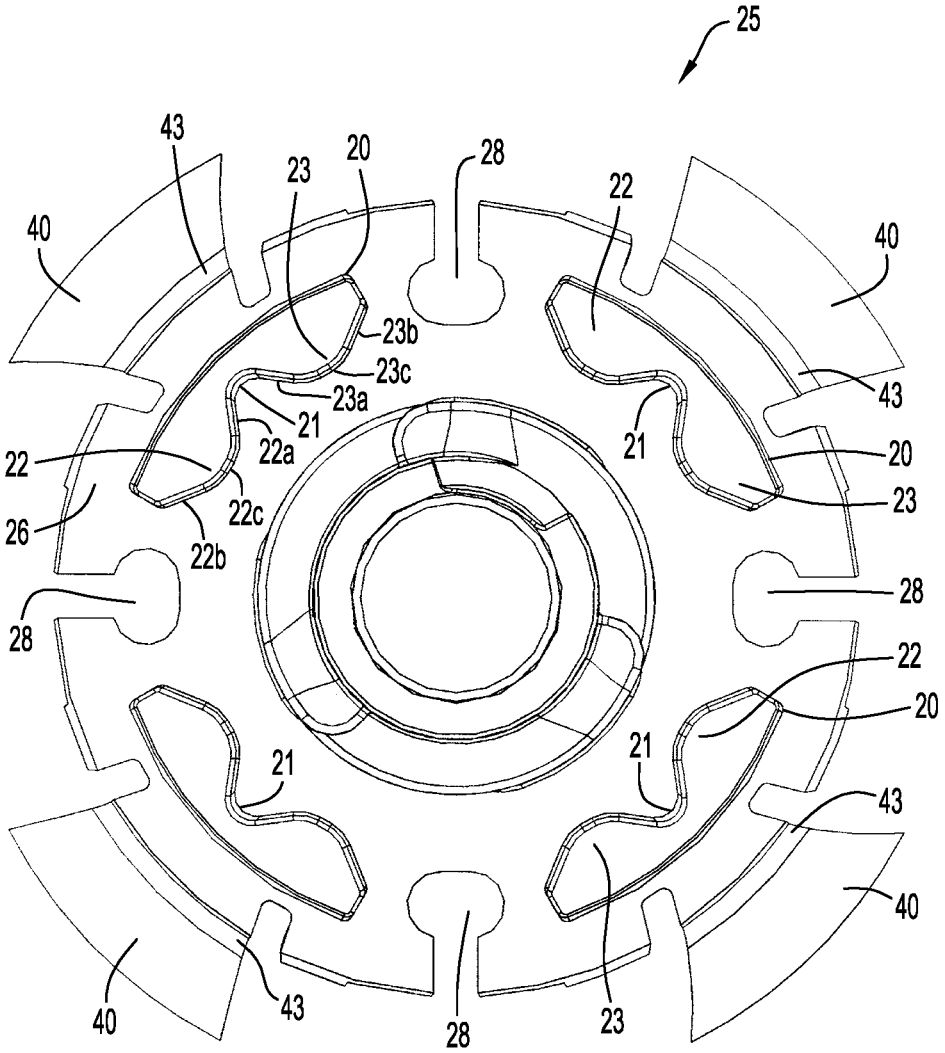
FIG. 8 is a top view of the base portion of the cleat of FIG. 3 without the dynamic traction portion and adjustment ring for purposes of clarity.
Figure 9:
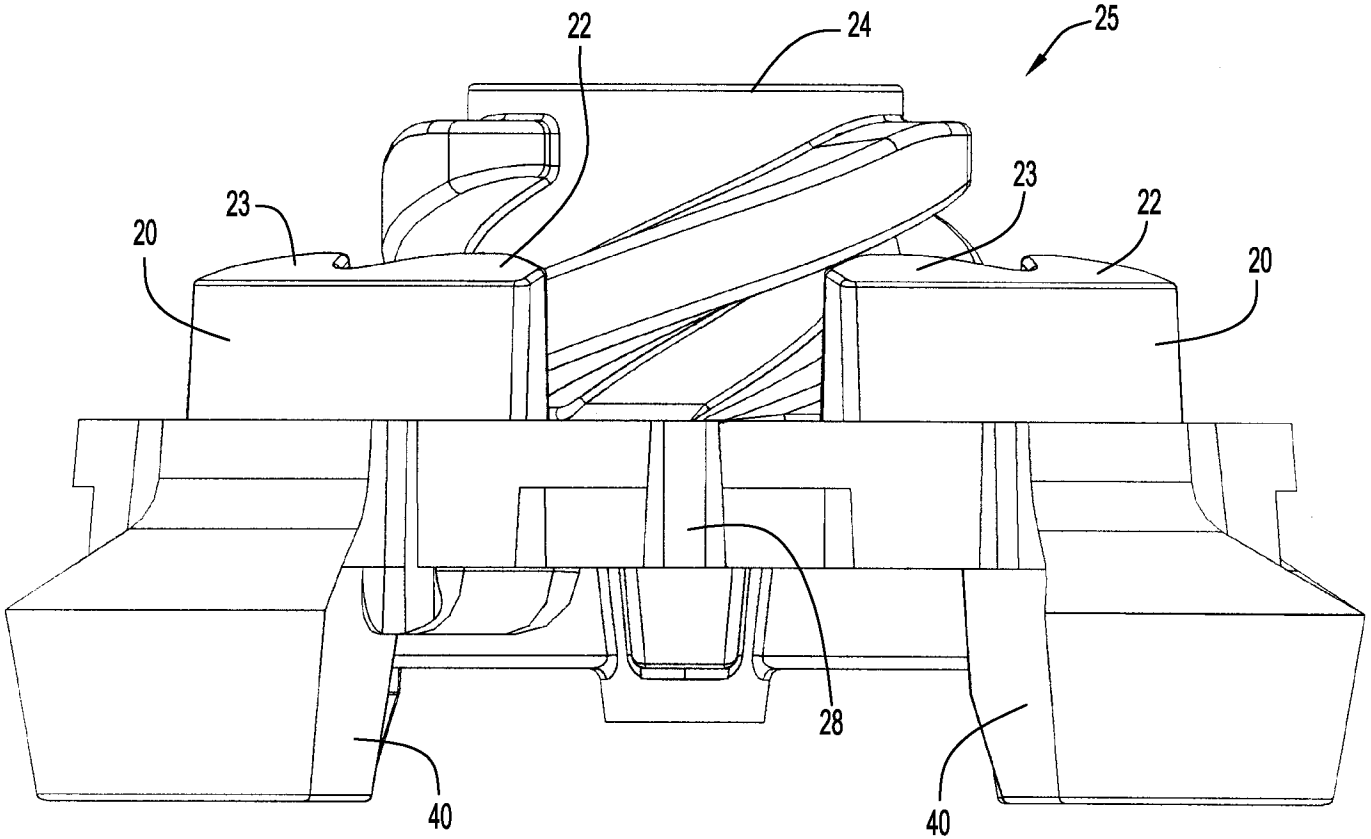
FIG. 9 is a side view in elevation of the base portion of FIG. 8.
Figure 10:
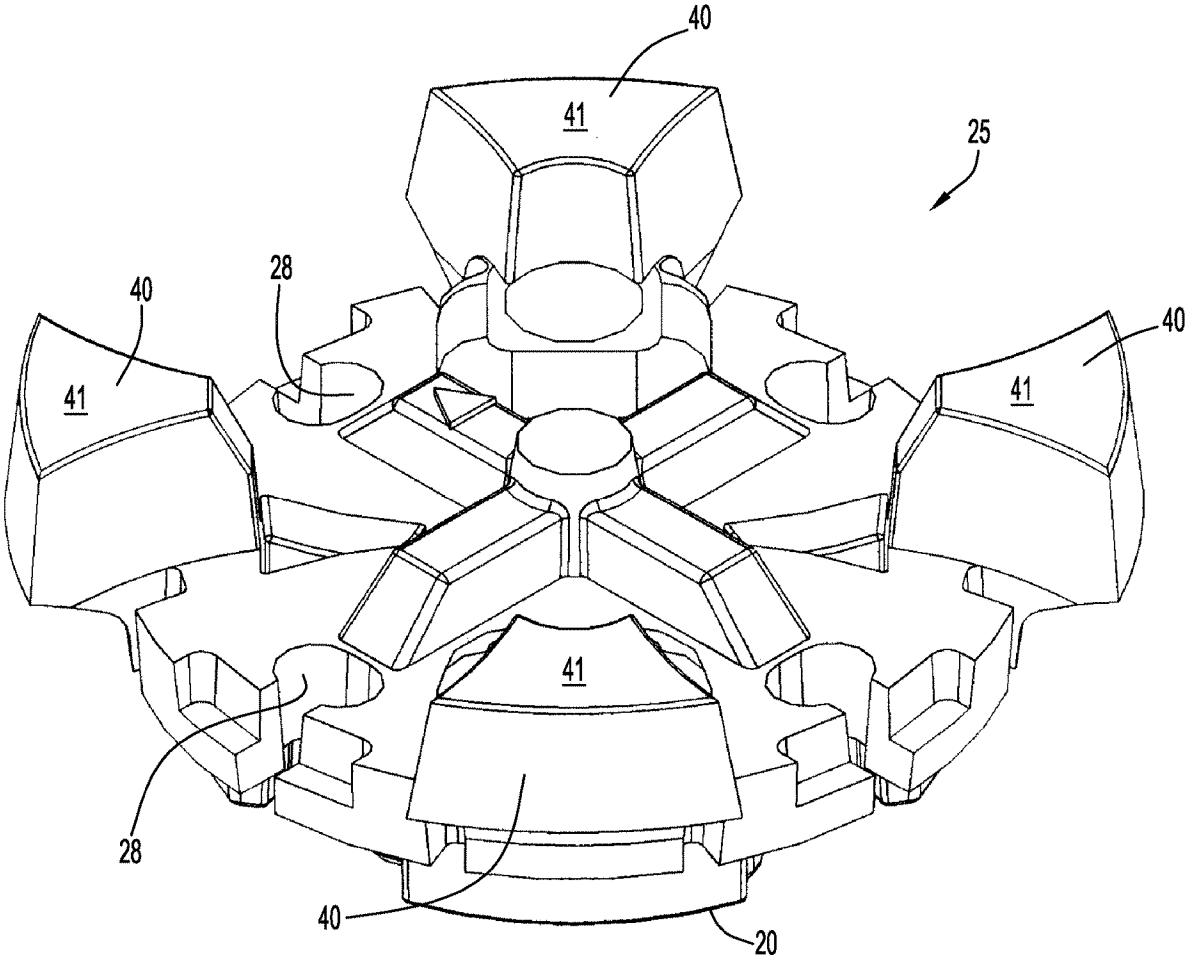
FIG. 10 is a bottom view in perspective of the base portion of FIG. 8.
Figure 11:
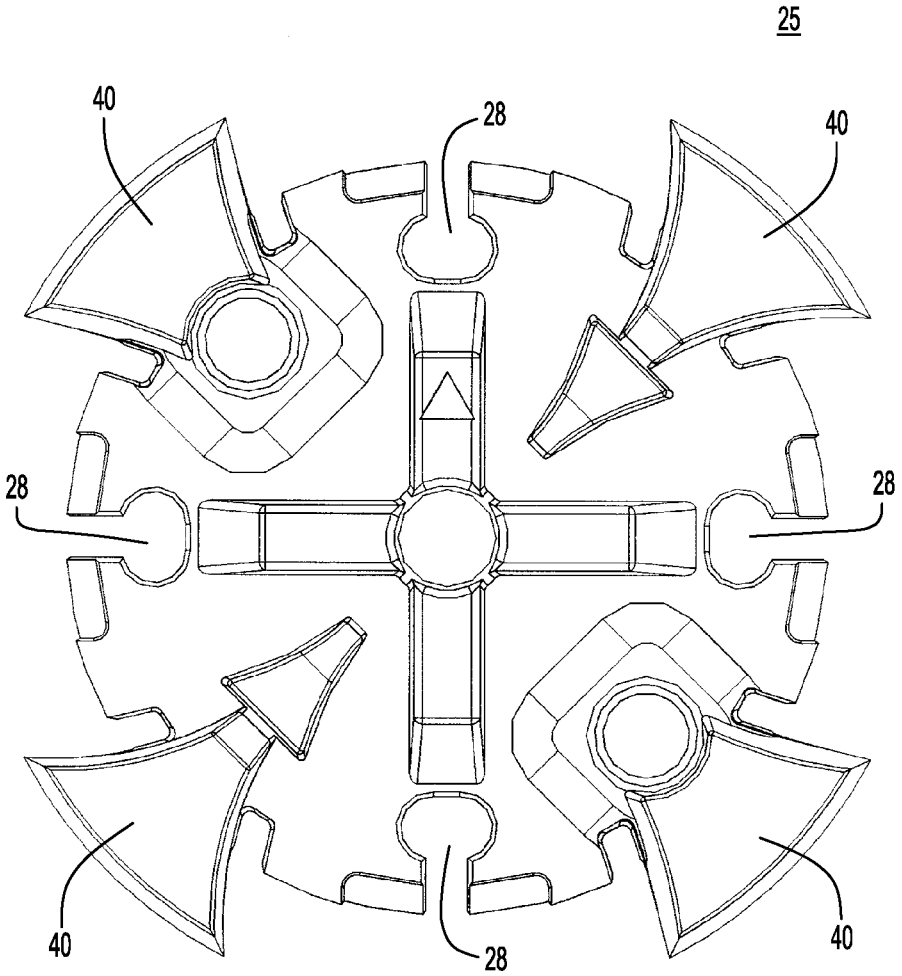
FIG. 11 is a top view in plan of the base portion of FIG. 6.
Figure 12:
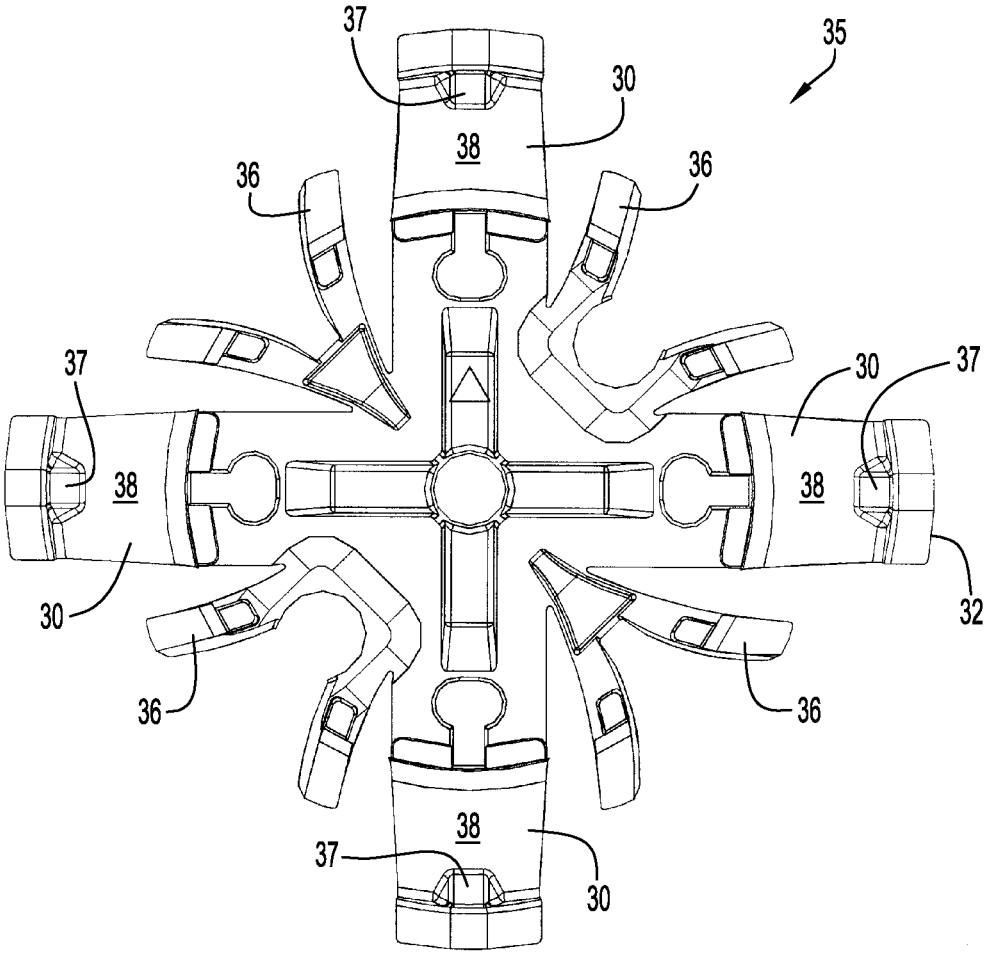
FIG. 12 is a top view in plan of the dynamic traction portion of the cleat of FIG. 3 without the base portion and adjustment ring for purposes of clarity.
Figure 13:
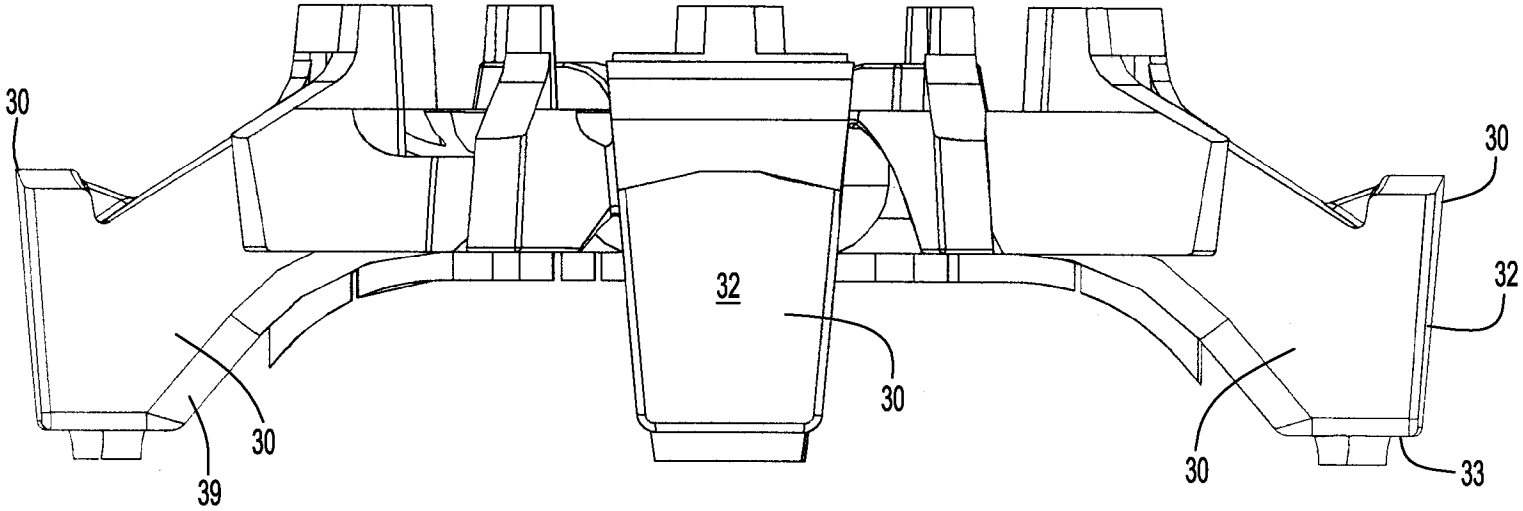
FIG. 13 is a side view in elevation of the dynamic traction portion of FIG. 12.
Figure 14:
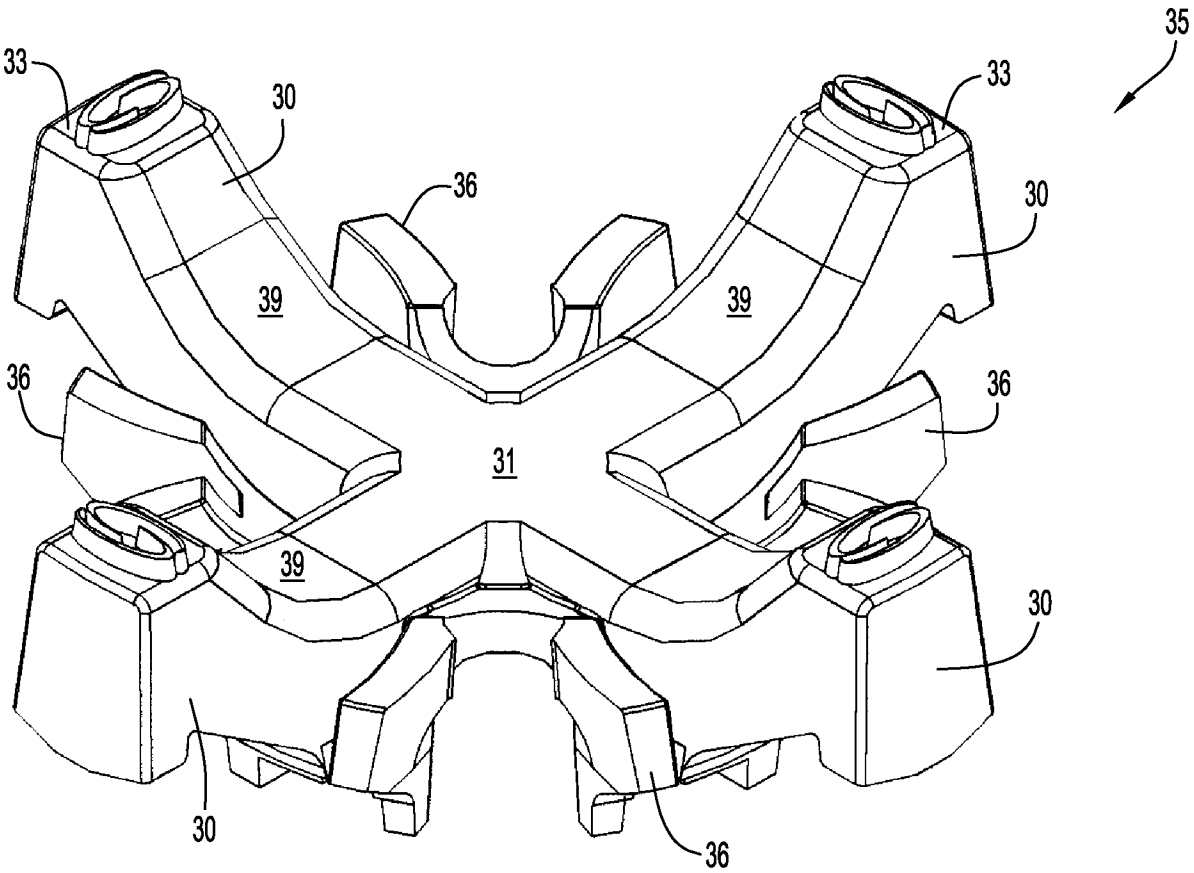
FIG. 14 is a bottom view in perspective of the dynamic traction portion of FIG. 12.
Figure 15:
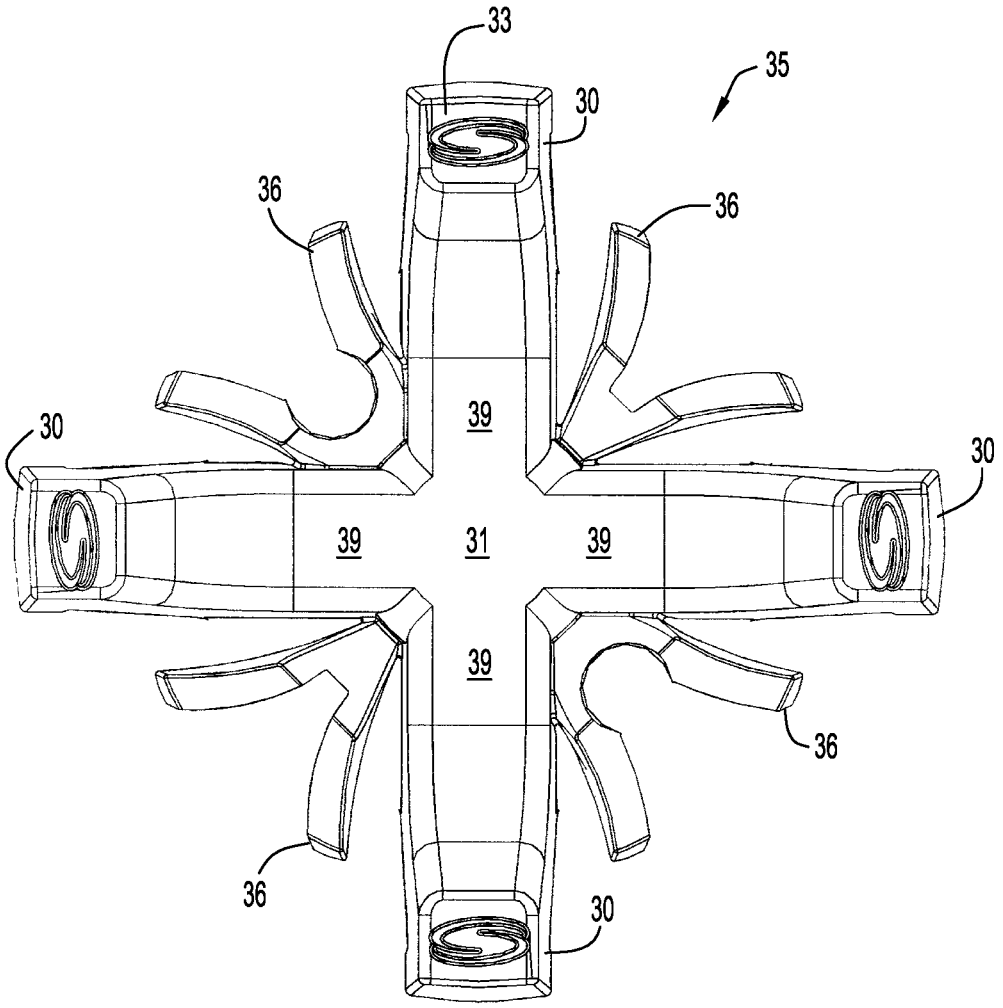
FIG. 15 is a bottom view in plan of the dynamic traction portion of FIG. 12.
Figure 16:
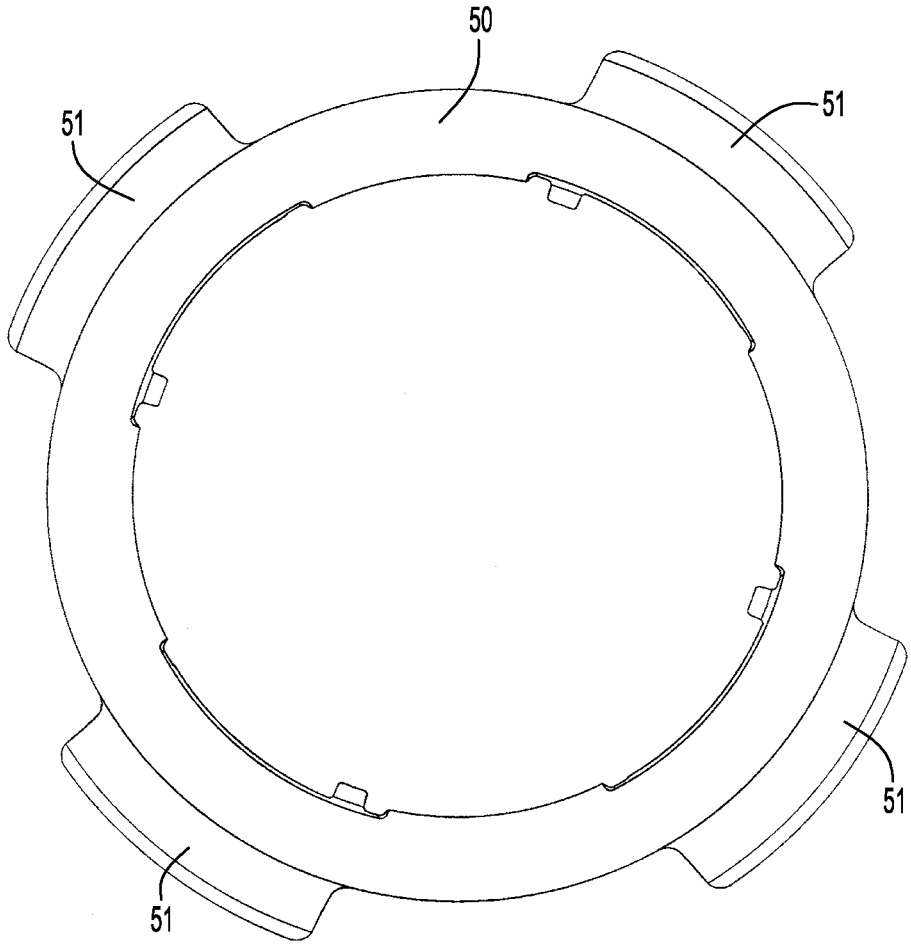
FIG. 16 is a top view in plan of the adjustment ring of the cleat of FIG. 3 without the base and dynamic traction portions for purposes of clarity.
Figure 17:
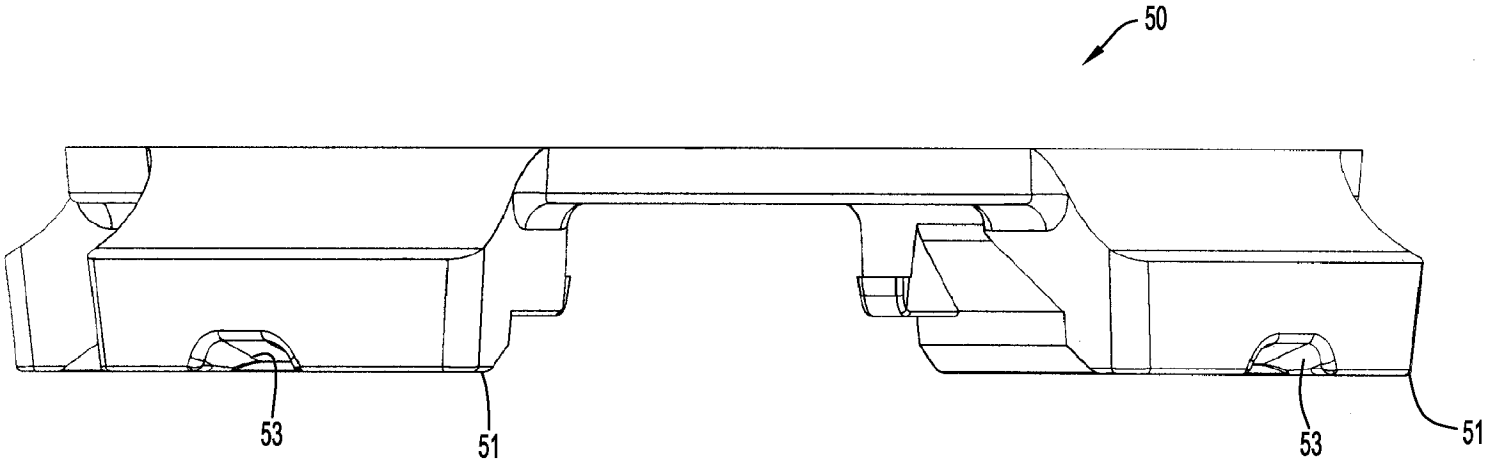
FIG. 17 is a side view in elevation of the adjustment ring of FIG. 16.
Figure 18:
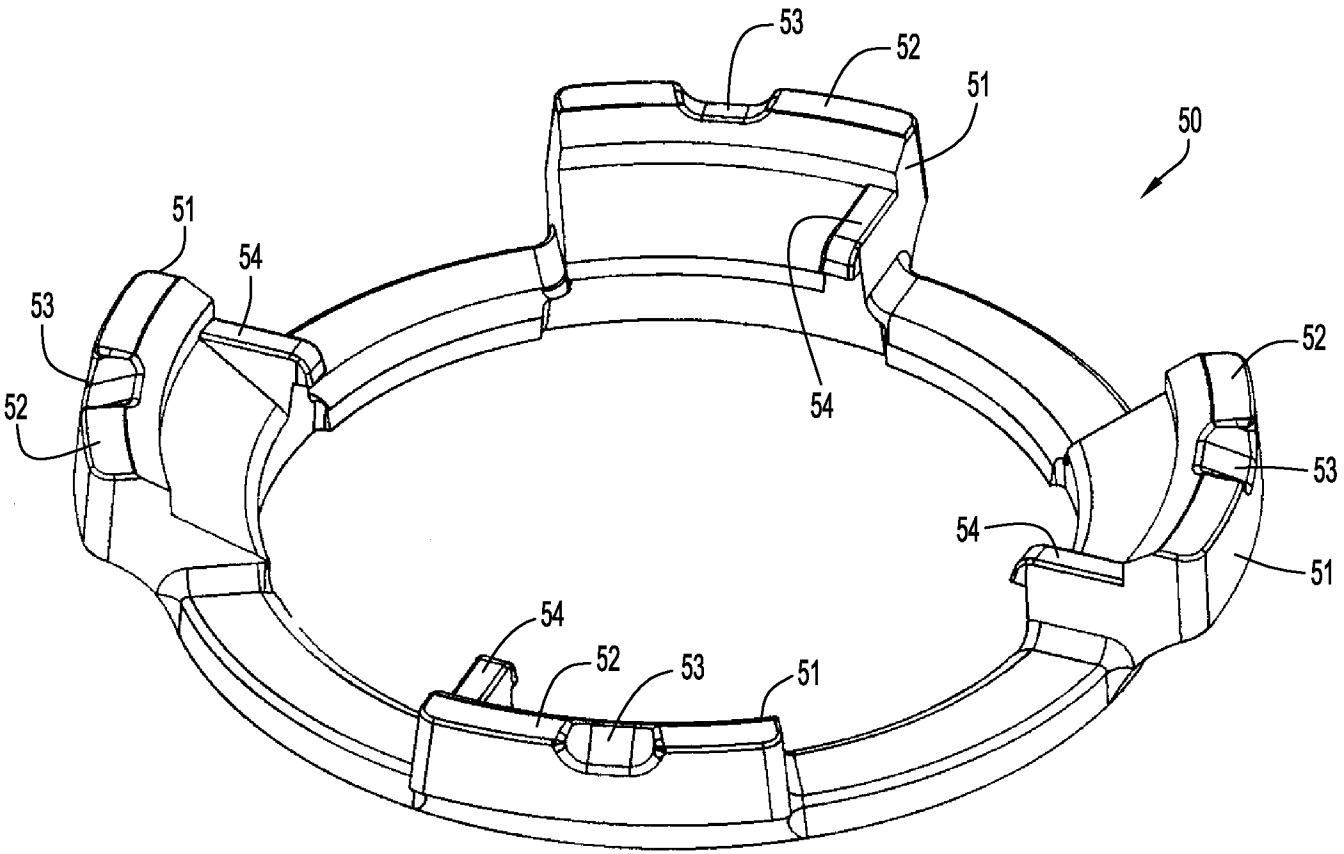
FIG. 18 is a bottom view in perspective of the adjustment ring of FIG. 16.
Figure 19:
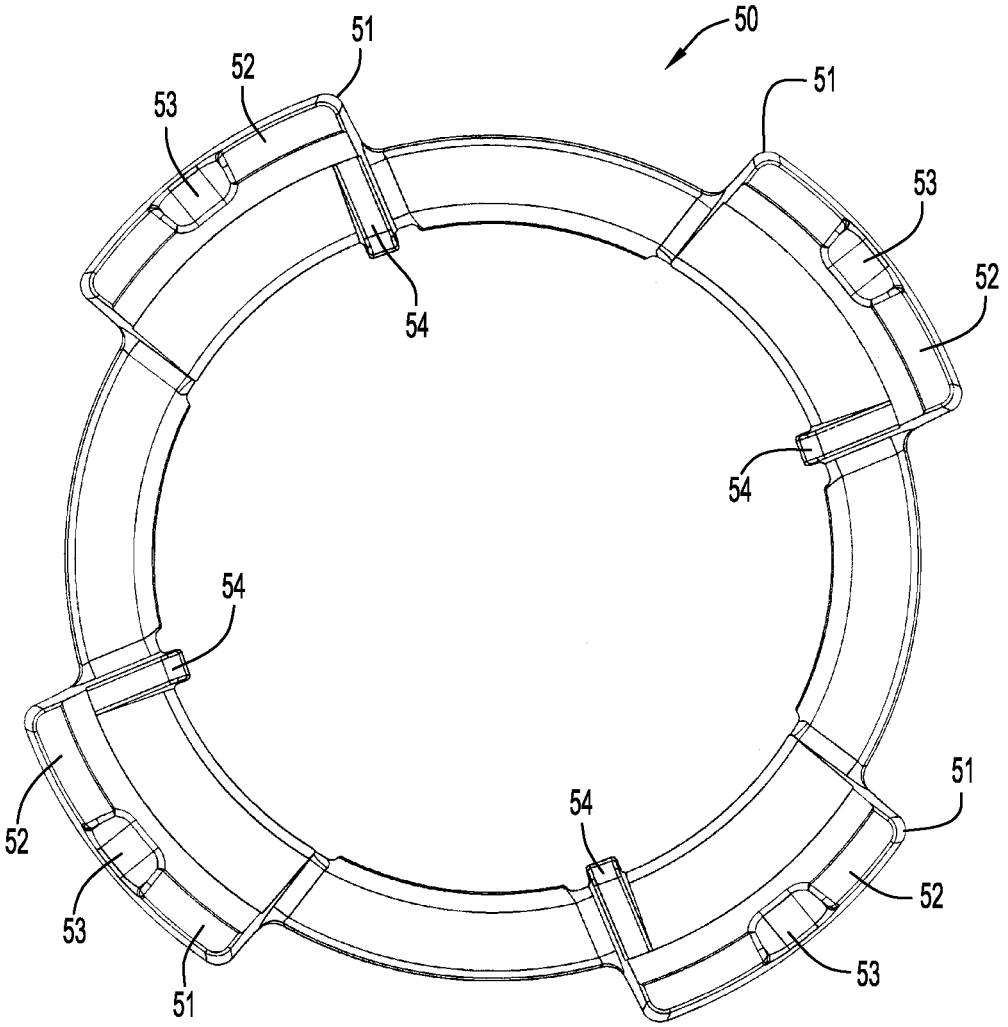
FIG. 19 is a bottom view in plan of the adjustment ring of FIG. 16.
Figure 20:
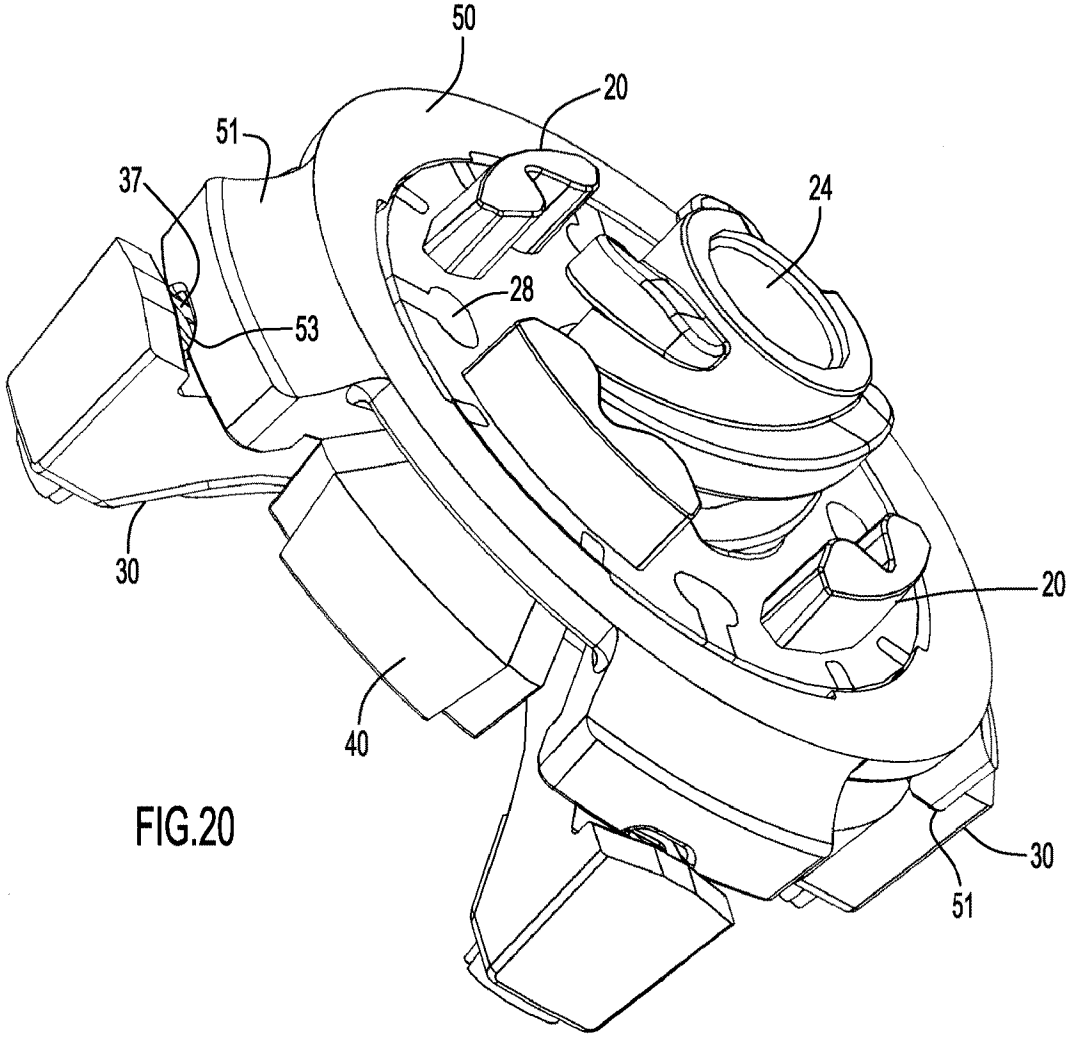
FIG. 20 is a top view in perspective of the cleat of FIG. 3 showing the adjustment ring in the locked position.
Figure 21:
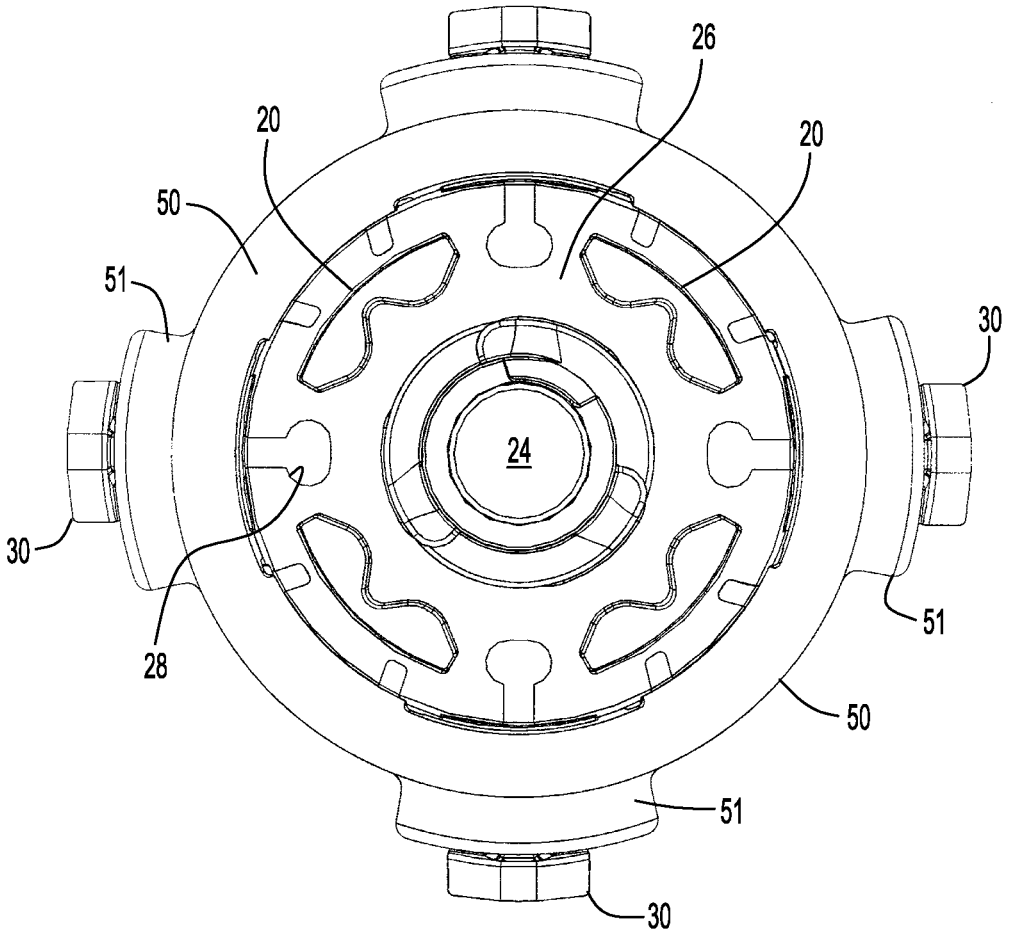
FIG. 21 is a top view in plan of the cleat of FIG. 20.
Figure 22:
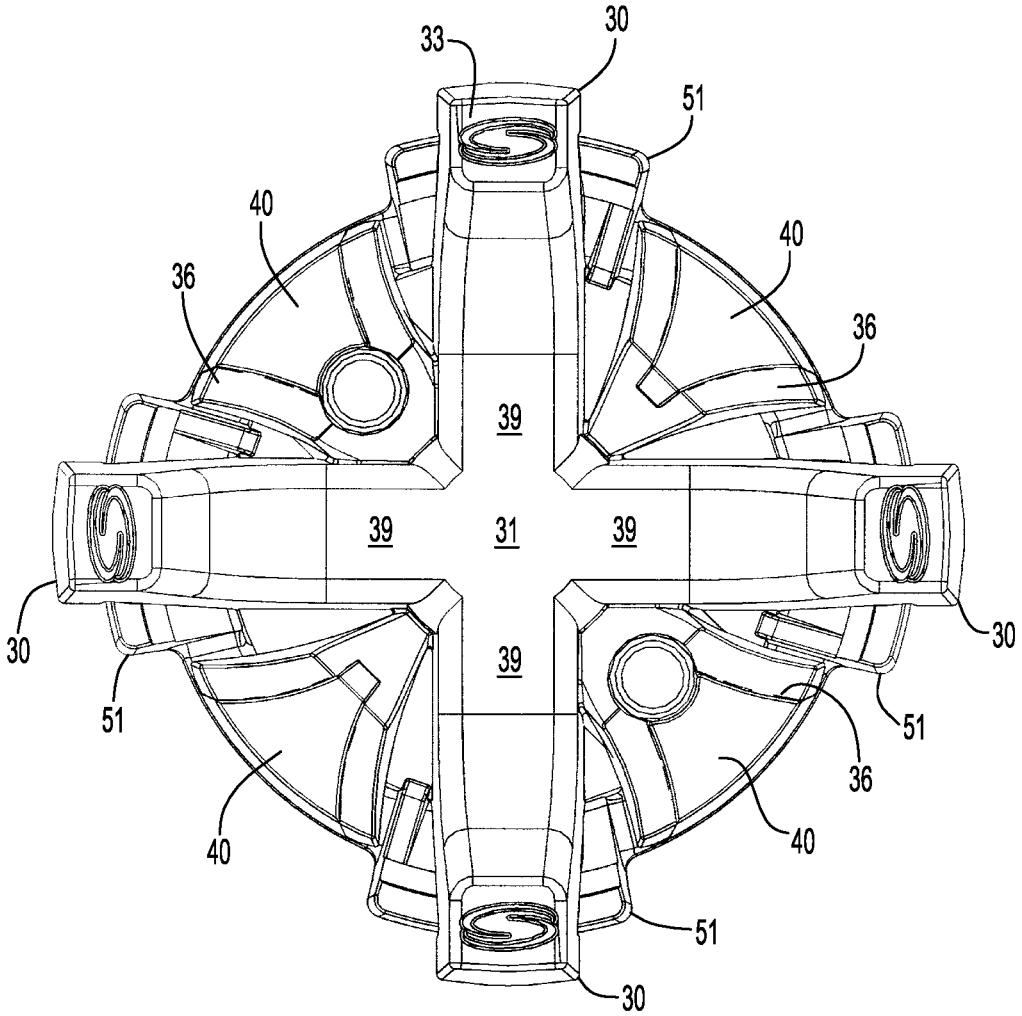
FIG. 22 is a bottom view in plan of the cleat of FIG. 20.
Figure 23:
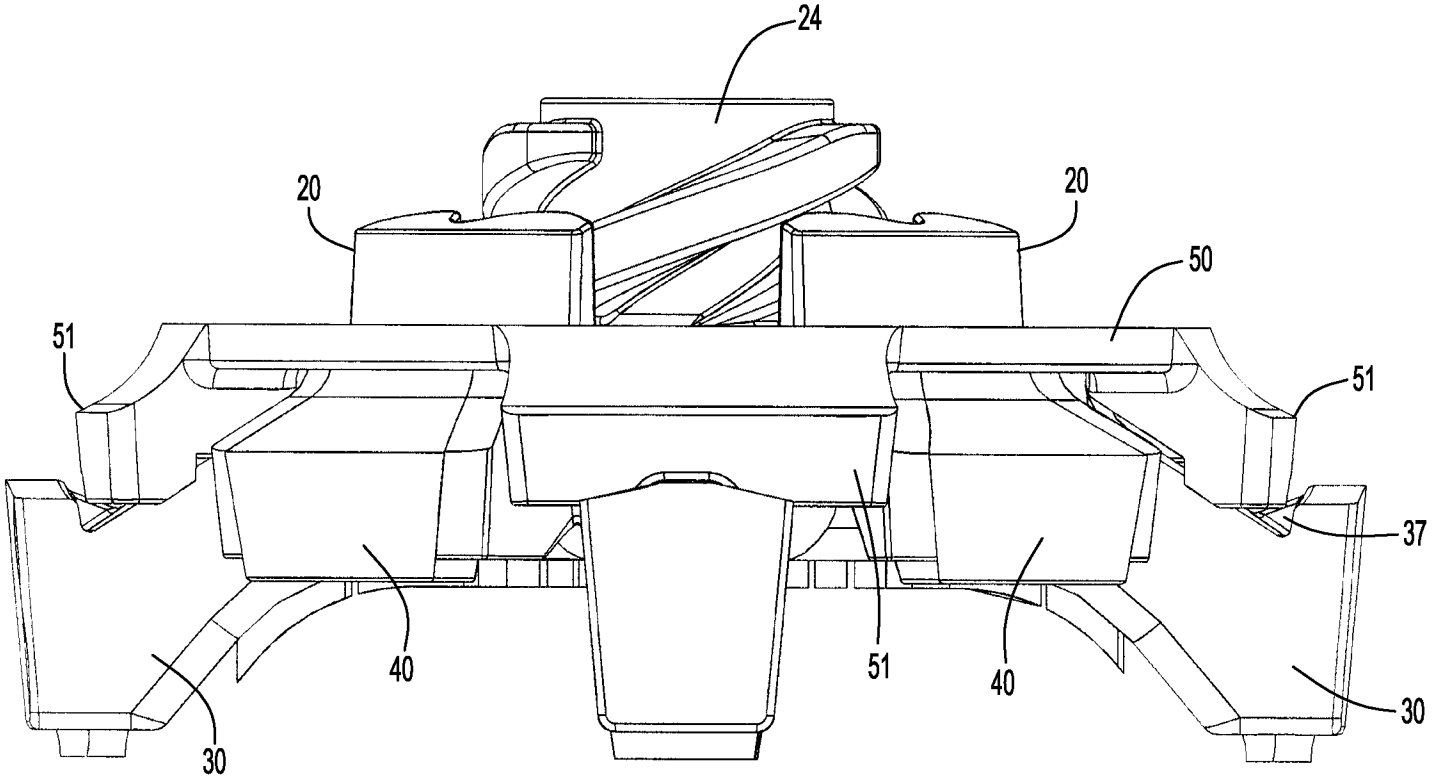
FIG. 23 is a side view in elevation of the cleat of FIG. 20.
Figure 24:
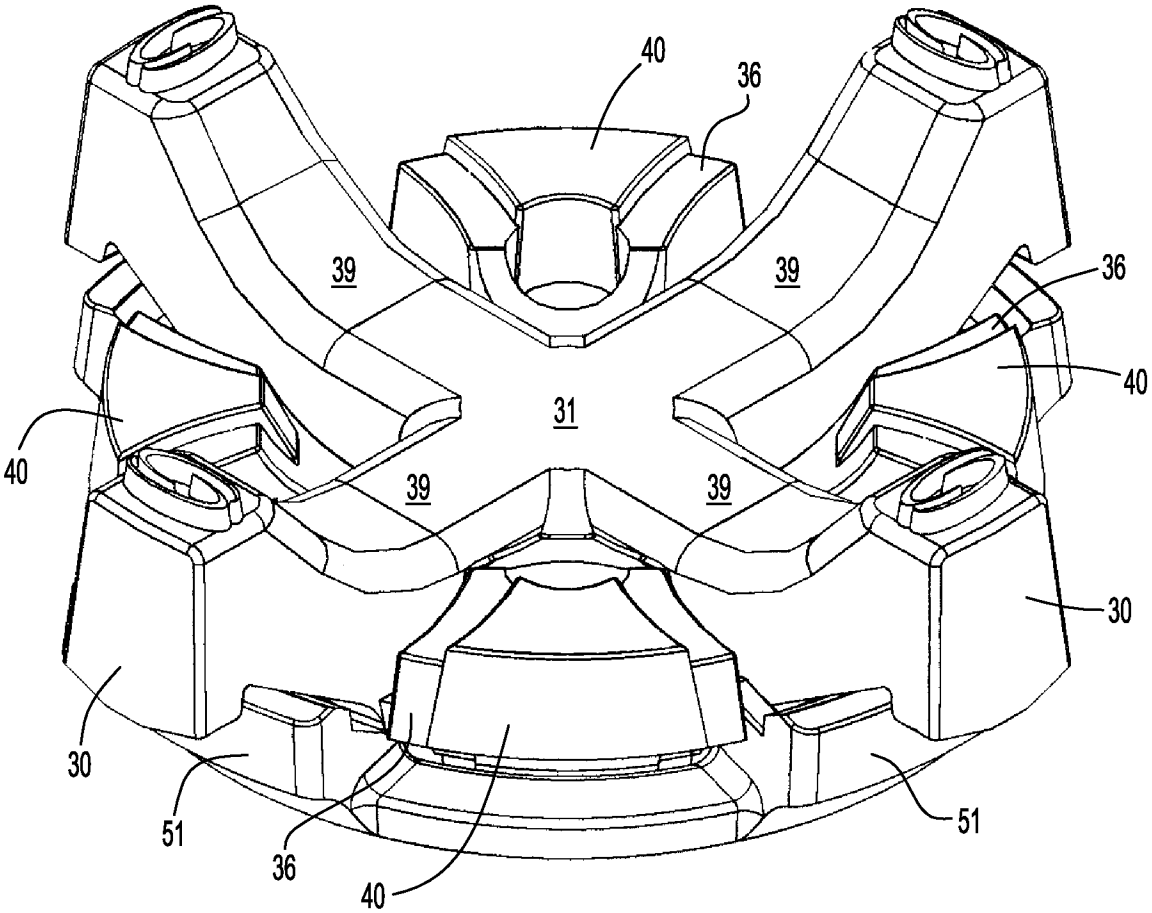
FIG. 24 is a bottom view in perspective of the cleat of FIG. 20.

Referring initially to FIGS. 1 and 2, there is illustrated a typical FAST TWIST® receptacle which is a unitary molding of plastic material including a circular plate 15 with a central hollow cylindrical boss 10 depending therefrom. The annular portion of plate 15 surrounding boss 10 serves as an anchoring flange for securing the receptacle in a shoe outsole, and is provided with an annular array of apertures 17 in which outsole material resides to assist in the anchoring function. A tiny projection 18 (which may alternatively be a recess) is located at one point of the periphery of plate 15 to permit angular orientation of the receptacle in the outsole.

The inner wall of boss 10 forms an internally screw-threaded socket adapted and configured to receive and engage a mating externally threaded stem on a cleat. The thread arrangement illustrated in FIGS. 1 and 2 is a three start thread, the lead-in points 12, 13 and 14 of which are angularly spaced by 120°.

The receptacle includes one part of a locking arrangement for preventing inadvertent removal of the engaged cleat from the socket after full insertion without interfering with the insertion process of the cleat in the receptacle. The receptacle part of the locking arrangement includes a ring of teeth11 formed on and extending from the outer wall of boss 10. The teeth become engaged with locking posts on the cleat, in the manner described below, during insertion of the threaded cleat stem into the receptacle socket, and resist rotation of the stem once it is fully inserted in the socket. The teeth 11 take the form of short stubby ribs which project axially (i. e., in the direction parallel to the central rotation axis of the socket) from plate 15. In transverse cross section the teeth 11 have a generally triangular form with a rounded apex presented to the cleat locking posts. In the illustrated embodiment the teeth are uniformly distributed co-axially about the socket axis, there being twelve such teeth disposed at intervals of 30°.

The following description refers in detail to FIGS. 3 through 24 in which a cleat according to one preferred embodiment is illustrated. FIGS. 3-7 illustrate the entire cleat which comprises a base portion 25, a dynamic traction portion 35 and an adjustment ring 50. The base and dynamic portions are molded together from two different polymers as an integral unit, typically in a two shot molding process wherein the relatively hard and inflexible base portion 25 is the first shot and the softer and more flexible dynamic traction portion 35 is the second shot. These portions are bonded together chemically and mechanically during the two-shot process to assure the structural integrity of the overall cleat. The base portion includes the hub 26 of the cleat, locking posts 20, a stem 24 with a multi-start thread for engaging the receptacle of FIGS. 1 and 2, and static traction elements 40 which are equally angularly spaced and project downwardly from a location adjacent the hub periphery.

The polymer material used for the dynamic traction portion is preferably softer and more flexible than the polymer material used for the base portion. The adjustment ring 50 is a separate part and, as described below, is movable relative to the integrally formed base and dynamic traction portions. To facilitate understanding, in addition to the showing of the entire cleat in FIGS. 3-7, the base portion 25 is shown separately in FIGS. 8-11, the dynamic portion is shown separately in FIGS. 12-15, and the adjustment ring is shown separately in FIGS. 16-19.

Referring to FIGS. 3-7 and FIGS. 8-11, the base portion 25 of the cleat includes a hub 26 of generally circular configuration having an externally threaded stem 24 projecting upwardly from its upper surface concentrically about a central longitudinal axis of the cleat extending perpendicular to the top and bottom surfaces of the hub. The external threads on stem 24, in the preferred embodiment, are configured to mate with the internal threads in the boss 10 of the receptacle illustrated in FIGS. 1 and 2. Four generally keyhole shaped slots 28 are defined at the hub periphery through the entire thickness of the hub, between its upper and lower surfaces, at equal angularly spaced locations. Slots 28 serve to receive polymer from the dynamic traction portion during the molding process and enhance the mechanical bond between the two portions.

Angularly midway between each pair of adjacent slots 28 is one of four static traction elements 40 in the form of a generally pie shaped wedge depending from the bottom surface and the peripheral rim of the hub and extending radially outward beyond the hub periphery. The static traction elements are substantially inflexible and their bottom surfaces 41 are relatively flat in order to serve as a bearing surface when forced downwardly against the ground under the weight of a person wearing a shoe on which the cleat is mounted. The radially outer surfaces of static traction elements 40 may be arcuate about the cleat axis. The proximal ends of the top surfaces of the static elements 40 terminate at the peripheral rim of the hub at a location slightly below the hub top surface to thereby define four angularly spaced co-planar points 43 of a plane serving as an annular support shoulder on which the bottom surface of adjustment ring 50 resides.

In the prior art locking arrangement between the receptacle of FIGS. 1 and 2 and a prior art cleat, the teeth 11 engage with different ones of six or twelve equi-angularly spaced individual locking posts disposed on the cleat in an annular array that is radially spaced from the threaded cleat stem 24. According to one aspect of the present invention, those individual locking posts are replaced with four dual locking post structures 20. Posts 20 extend upwardly from the top surface of the hub 26 and are equally spaced angularly along that top surface at a radial location slightly inboard of the hub periphery. The radial location of the posts is such that they physically interact in the manner described below with the teeth 11 of the receptacle illustrated in FIGS. 1 and 2. The specific angular locations of posts 20 are such that each post is positioned substantially midway between two slots 28.

Each post 20 has a generally arcuate outwardly facing surface and an inwardly facing locking surface comprising two post sections 22, 23 joined by an angularly centered recess 21. The radial location of the posts relative to the cleat central axis combine with the configuration of recess 21 to permit each recess to receive and retain a respective tooth 11 of the receptacle shown in FIGS. 1 and 2. Post sections 22 and 23 have respective interior ramp segments 22*a*, 23*a* proximate recess 21 that converge to form recess 21 which is located at the angular center of the post and is rounded at its nadir. Post sections 22, 23 also have respective exterior ramp segments 22*b*, 23*b* that mutually diverge outwardly from the hub center. The interior and exterior ramp segments of each post section intersect at a respective rounded apex 22*c*, 23*c* that faces generally toward the hub center. The angularly outer ends of ramp segments 22*b* and 23*b* terminate at respective short flat edges. Each post 20 is angularly symmetrical about an imaginary line extending radially from the cleat central axis through the nadir of recess 21.

The slope of the interior ramp segments 22*a*, 23*a* is greater than the slope of the exterior ramp segments 22*b*, 23*b*; that is, segments 22*a* and 23*a* converge at an angle that is smaller than the angle at which segments 22*b* and 23*b* diverge. As a result, as the threaded stem 24 is rotated in socket 10 (FIGS. 1 and 2), teeth 11 slide relatively easily along the more shallowly sloped exterior ramp segments 22*b* or 23*b*, forcing the post structure to slightly deflect radially outward in a resilient manner about its root at the top surface of the hub. However, once passing the apex 22*c* or 23*c* and reaching recess 21, the teeth must pass the more steeply sloped interior ramp sections 22*a* or 23*a* to exit the recess, and can do so only with the exertion of greater torque applied to the cleat, thus enhancing the locking force opposing removal of the cleat from the receptacle.

The configuration of each post 20 may be viewed as half an hourglass with recess 21 simulating the neck of the hourglass. This configuration of two ramp segments on each post to engage adjacent teeth on the receptacle provides the effective locking function of two of the post configurations in the prior arrangements described above. Thus, instead of the locking effect of six posts engaged with receptacle locking teeth 11, the present invention, with four dual locking posts, has the locking effect of eight locking posts. Importantly, four symmetrical dual locking posts 20 permit the angular spacing between them to be greater than the spacing between each of the prior art six or twelve equally spaced individual locking posts. This in turn permits plastic material to be eliminated from the hub between the dual post to thereby reduce the cost of the cleat without sacrificing structural support for the posts. Moreover, as described below, the eliminated material can provide an access slot for a dynamic traction element to increase the degree of permissible flexure of that element.

In accordance with another aspect of the present invention, the traction and "feel" of a cleat are adjustable. In one embodiment of this aspect of the invention the adjustment ring 50 cooperates in a selective manner with the dynamic traction portion 35 of the cleat. Referring to FIGS. 12-15 as well as FIGS. 3-7 and 20 -24, the dynamic traction portion 35 of the cleat includes a central region 31 which, in the complete cleat assembly, resides immediately beneath and axially centered with respect to hub 26. Four dynamic traction elements 30, spaced at equal angles, extend generally radially outward at angular positions intermediate the angular positions of static traction elements 40. Each dynamic traction element has an arm portion that terminates in a distal traction head. The underside or bottom surface 39 of the arm portion has a proximal end located at or proximate central region 31, well inboard of the hub periphery. The top surface 38 of the element arm has its proximal end at the hub periphery. Surfaces 38 and 39 slope outwardly and downwardly and terminate in a distal traction head. The radially outer surface 32 of the traction head is flat or just slightly arcuate and is either parallel to the cleat axis or angled slightly inwardly and downwardly. The bottom surface 33 of the traction head is either flat or may be provided with a barb, as show, to enhance traction and/or to serve as a logo to identify the cleat or shoe manufacturer. The top surface 34 of the traction head is raised from the top surface 38 of the element arm and is preferably flat for reasons described below. A short gusset 37 extends in the crotch between the inward facing surface of the traction head and the top surface 38 of the arm of element 30.

With the root or proximal end of the bottom surface 39 of each dynamic traction element 30 located proximate central region 31, the resiliently flexible dynamic traction element is effectively suspended from that inboard location in a cantilever manner rather than from the hub periphery. As a result, the traction element has more angular space within which to flex than an element having its entire proximal end joined to the hub periphery. Such flexure may be upward toward the shoe outsole under the weight of the wearer of the shoe, or it may be downward and radially inward (i.e., back on itself) in response to lateral force against outer surface 32. Downward and inward flexure results in resilient bending of the traction head toward the cleat axis beneath the hub, thereby extending the effective length of element 30 opposing lateral movement through grass and turf. In either case, the elongated cantilever arm resulting from attachment of the root of the dynamic traction element under surface at or near central region 31 increases the tractional capability of the element.

Dynamic traction portion 35 also includes four angularly spaced guide members 36 disposed at four angularly spaced locations between the dynamic traction elements 30. Guide member 36 are each bifurcated to form two diverging arms that extend along opposite sidewalls of a respective static traction element 40 on base portion 25 in the molded cleat unit. As the static traction element wears away, the arms of the guide members assist in providing a non-slip feature for the cleat. Specifically, the softer dynamic traction material of the guide member arms eventually contacts the ground as the static element material wears away and assists the static element in providing traction. Two of the guide members, disposed on diametrically opposite sides of central region 31, are provided with circular openings at the vertex of the diverging arms to receive pins from a wrench that functions as a cleat installation and removal tool.

Adjustment ring 50, illustrated in FIGS. 16-19, as well as in FIGS. 3-7 and 20-24, is a radially short and axially thin annular member with four projections 51 that are equally angularly spaced and project radially outward and downward from the ring periphery. The adjustment ring can be secured to the base member in either of two rotational (i.e., angular) positions, namely a parked position (illustrated in FIGS. 3-7) and a locked position (illustrated in FIGS. 20-24). In the locked position the adjustment ring prevents the dynamic traction elements from flexing, thereby adjusting the cleat to be essentially a static traction cleat. In the parked position the adjustment ring does not interfere with flexure of the dynamic traction element. The bottom surface of ring 50 is configured to reside on the annular support shoulder defined by the proximal ends 43 of the top surfaces of the four static traction elements 40 adjacent the rim of hub 26. Each projection 51 has a narrow bottom edge 52 at its distal end. Edge 52 is substantially planar except for an angularly centered notch 53 configured to receive and firmly engage gusset 37 located behind the traction head of a dynamic traction element 30 in the ring locked position. In this position, as illustrated in FIGS. 20-24, the top surface of ring 50 resides co-planar with the top surface of hub 26 and the distal end edge 52 of projection 50 projects downward into the crotch defined between the inward side of the traction head and the top surface 38 on the dynamic traction element 30. The upper surface of projection 51 is configured to abut the bottom of a shoe outsole in which the receptacle of FIGS. 1 and 2 is mounted, thereby preventing upward vertical movement of dynamic traction element 30. Thus, with ring 50 in this locked position, if an upward force is applied to the dynamic traction elements, such as by the weight of a wearer of a shoe, projections 51 prevent the dynamic traction elements 30 from flexing, thereby effectively eliminating dynamic traction and providing a harder "feel" for the wearer.

The parked or inactive position of adjustment ring 50 is approximately 45° displaced from the locked position and is best illustrated in FIGS. 3-7. In this position, projections 51 of the adjustment ring are angularly aligned with static traction elements 40, leaving dynamic elements 30 free to flex in response to applied forces, and thereby retaining the dynamic traction capability of the cleat. The underside of projections 51 may be provided with one or more guide flanges 54 to engage one or more sides of the dynamic traction element 30 in the ring locked position or the static traction element 40 in the ring parked position. Flanges 54 facilitate positioning of the ring during positional changes and restrict inadvertent rotation of the ring once placed in either of its positions.

It will be appreciated that when ring 50 is in its parked position, maximum dynamic traction element flexibility and softness of feel is effected. These dynamic traction elements, when stressed by the weight of the wearer of the shoe and not prevented from flexing, can flex in a vertical direction (i.e., upward toward the shoe sole). Thus, these elements do not spread outwardly and therefore the cleat can occupy a much smaller space on the shoe sole than cleats with conventional dynamic elements that do spread radially outward when flexed. In fact, as a result of the relatively large area of the substantially vertical outward facing surface 32 of the dynamic element traction head, horizontal forces applied to that surface when the cleat is moved laterally through grass and turf (i.e., when the wearer's shoe slips attempts to slip sideways) cause the traction head and the arm of dynamic element 30 to resiliently bend inwardly on itself as it resists such movement.

Regarding the differences in "feel" and traction afforded by the two positions of adjustment ring 50, the dynamic traction elements 30 are longer than the static elements 40. Accordingly, when the wearer of the shoe steps down on the ground or turf, the distal ends of dynamic elements 30 make first contact with the ground. In the parked position of ring 50 (illustrated in FIGS. 3-7), the dynamic traction elements 30 are free to flex and flex upwardly or vertically as described above. Hence, they gradually resiliently yield to the weight of the wearer, providing a soft feel and dynamic traction. In the locked position of ring 50 (FIGS. 20-24) the projections 51 prevent significant flexure of dynamic elements 30. Thus, the distal ends of elements 30 do not deflect and, along with static elements 40, provide a harder feel without dynamic traction with each step taken by the wearer.

It should be noted that if traction and softness of "feel" adjustability is not a desired feature for a particular cleat, the ring 50 can simply be eliminated.

The adjustable traction feature of the invention is shown in the preferred embodiment to utilize locking ring 50 to selectively prevent flexure of the dynamic traction elements. It should be noted however, that the adjustable traction can be achieved without the need for a separate ring member. Specifically, it is well known that by providing suitable indexing structures in association with the threaded engagement between the cleat and its receptacle, one can selectively provide different final rotational or angular positions of the cleat relative to the shoe outsole. Multi-start threads such as described above in connection with threaded stem 24 and the threaded receptacle in FIGS. 1 and 2, permit multiple final rotation positions of the cleat in the receptacle. These positions are often limited, such as by providing keyways or other structure, to limit the number of permissible angular starting positions and thereby define the permissible final position(s). With this in mind, it is possible to provide suitably positioned topographical features in the outsole surface, such as flexure impeding structures or projections and flexure permissive regions or recesses that interfere with or permit flexure of the dynamic elements depending on the selected rotational position of the cleat. In fact, by providing these structures or recesses at different heights it is possible to provide for three or more degrees of flexure that depend on the angular position of the cleat in the shoe outsole. Referring to FIGS. 25-30, an outsole 60 is provided with a repeating annular array of topographical features comprising such structures and recesses. Each array includes, in clockwise succession, a recess 61 into the outsole surface, a structure 62 depending from the outsole surface, and a blank area 63 having no structure or recess. The illustrated cleat, much like the cleat illustrated and described above, includes four equally angular spaced dynamic traction elements 72 angularly interspersed with four equally angular spaced static traction elements 71. The height of flexure impeding structure 62 corresponds to the spacing between the outsole 60 and the traction head 73 of dynamic traction element 72 when that traction element is in its quiescent state (i.e., unflexed). The depth of recess 61 is determined by the degree of maximum flexure desired for traction element 72. Typically, recess 61 is contoured to match the contour of traction head 73. With four dynamic traction elements in the cleat as shown, those elements are angularly spaced by 45°. Therefore, to maintain equal spacing between recess 61 and structure 62, and between structure 62 and the blank area 63, such spacing would be 15°. It is to be understood that if the array includes additional structures of different heights, the spacing would be reduced accordingly.

Figure 25:
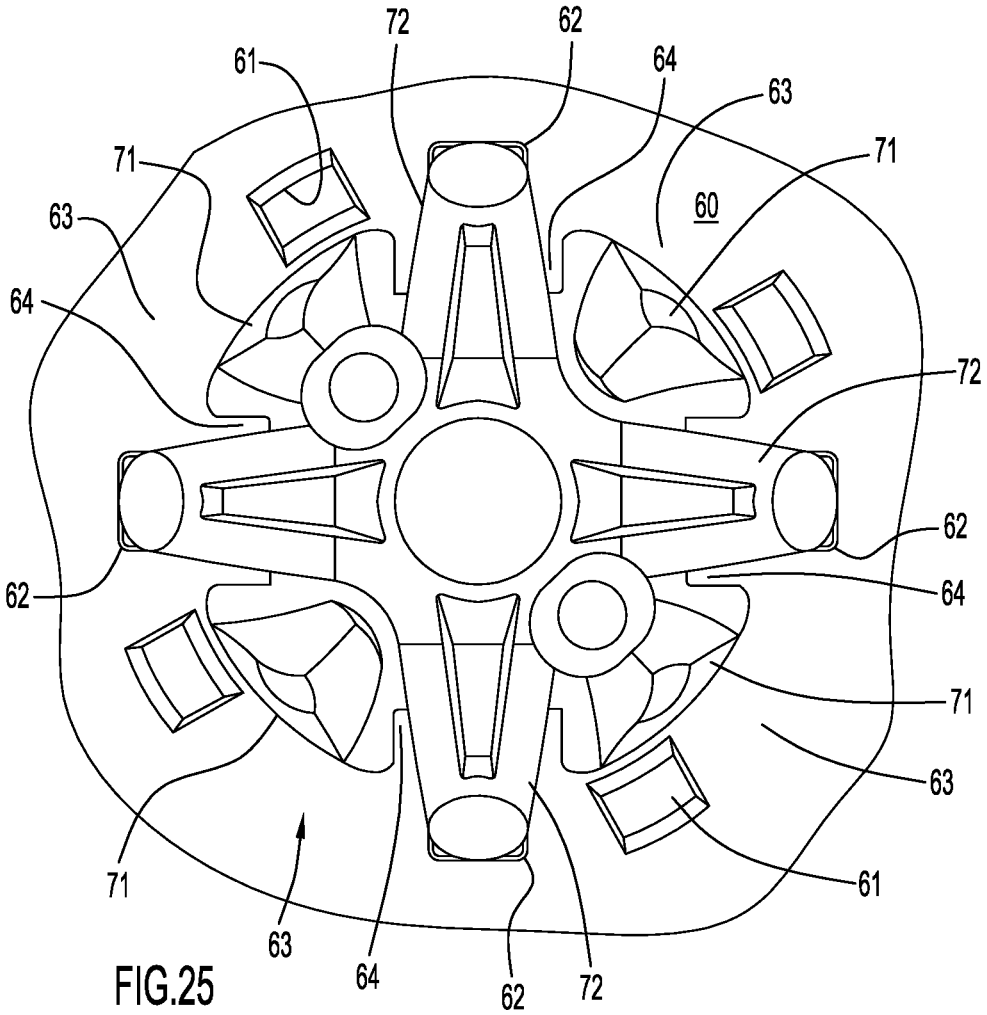
FIG. 25 is a view in plan showing the cleat of FIG. 3 without the adjustment ring secured to a shoe outsole having traction adjustment elements, and with the cleat rotationally positioned to prevent flexure of its dynamic traction elements.
Figure 26:
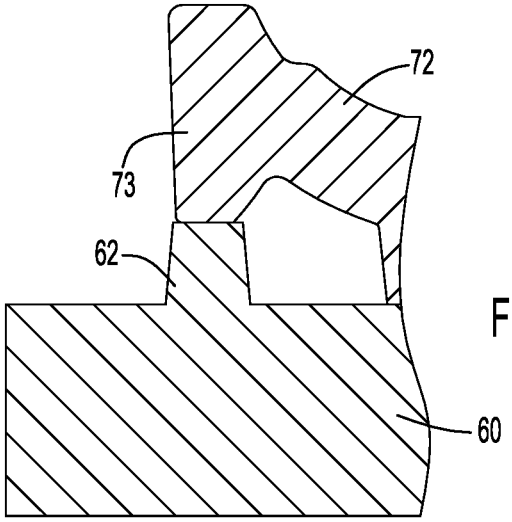
FIG. 26 is a diagrammatic view in section illustrating the interaction between a dynamic traction element of the cleat of FIG. 25 and a traction adjustment element on the outsole.

As seen in FIGS. 25 and 26, with the cleat position such that the unflexed dynamic elements are rotationally aligned with structures 62, the flat upper surface of the traction head abuts the flat bottom surface of structure 62. Accordingly, if vertical force is applied to the traction element by the weight of the wearer of the shoe, the dynamic elements 72 are incapable of flexing. In this position of the cleat, the "feel" for the wearer is relatively hard and the tractional effects are substantially static rather than dynamic.

Figure 27:
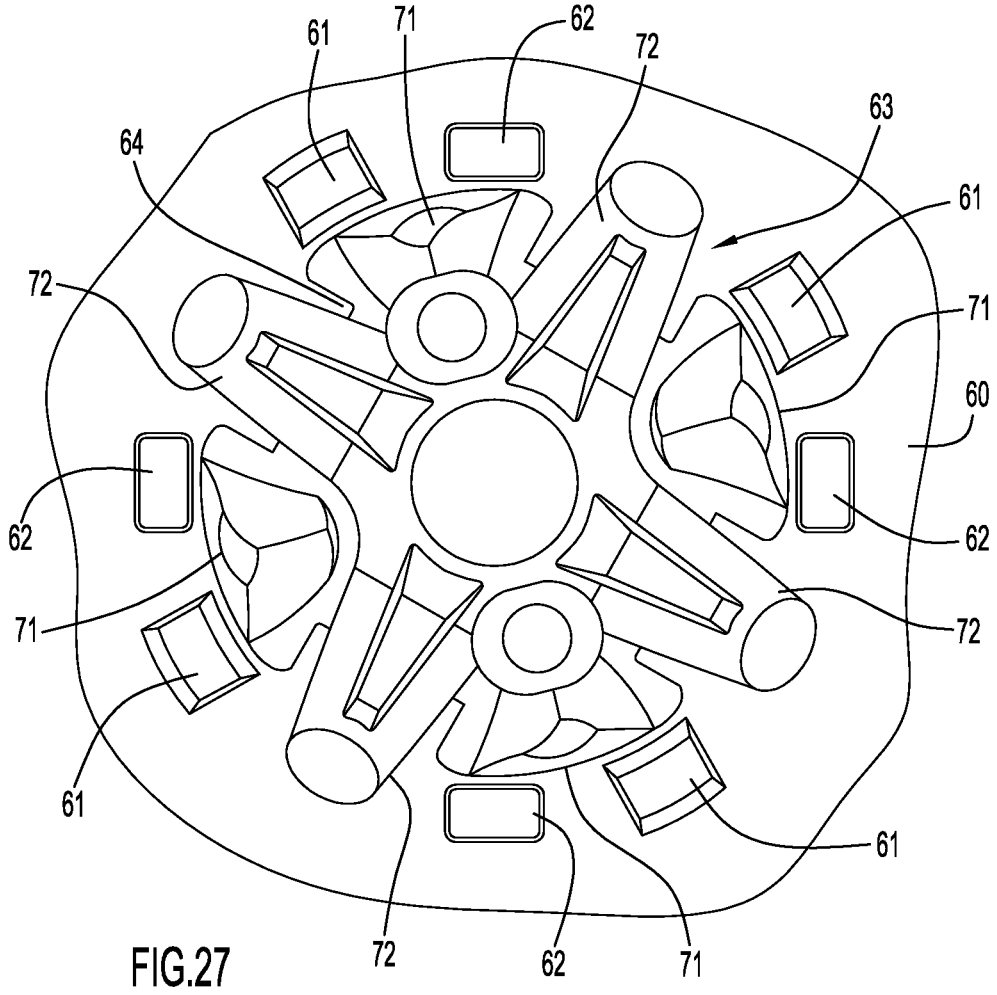
FIG. 27 is a view in plan similar to that of FIG. 25 but with the cleat rotationally positioned to permit intermediate flexure of its dynamic traction elements.
Figure 28:
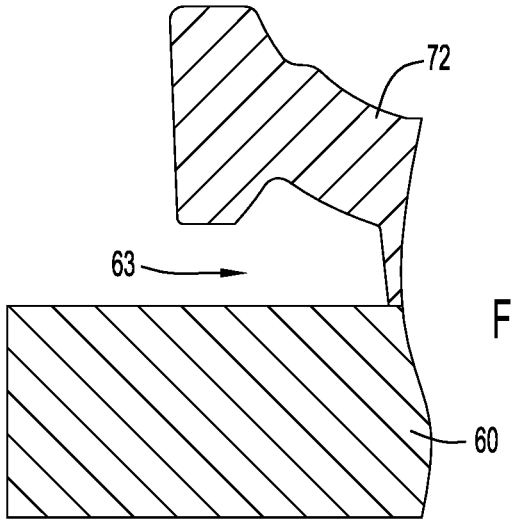
FIG. 28 is a diagrammatic view in section illustrating the dynamic traction element relative to the outsole for the cleat position illustrated in FIG. 27.

The cleat position shown in FIGS. 27 and 28 has the dynamic traction elements 72 angularly aligned with the blank spaces 63 in each array. Vertical forces applied to traction element 72 in this cleat position cause the elements to flex until their respective traction heads abut the outsole surface. In this position the "feel" is intermediate soft and hard, and there is an intermediate dynamic component to the tractional effect.

Figure 29:
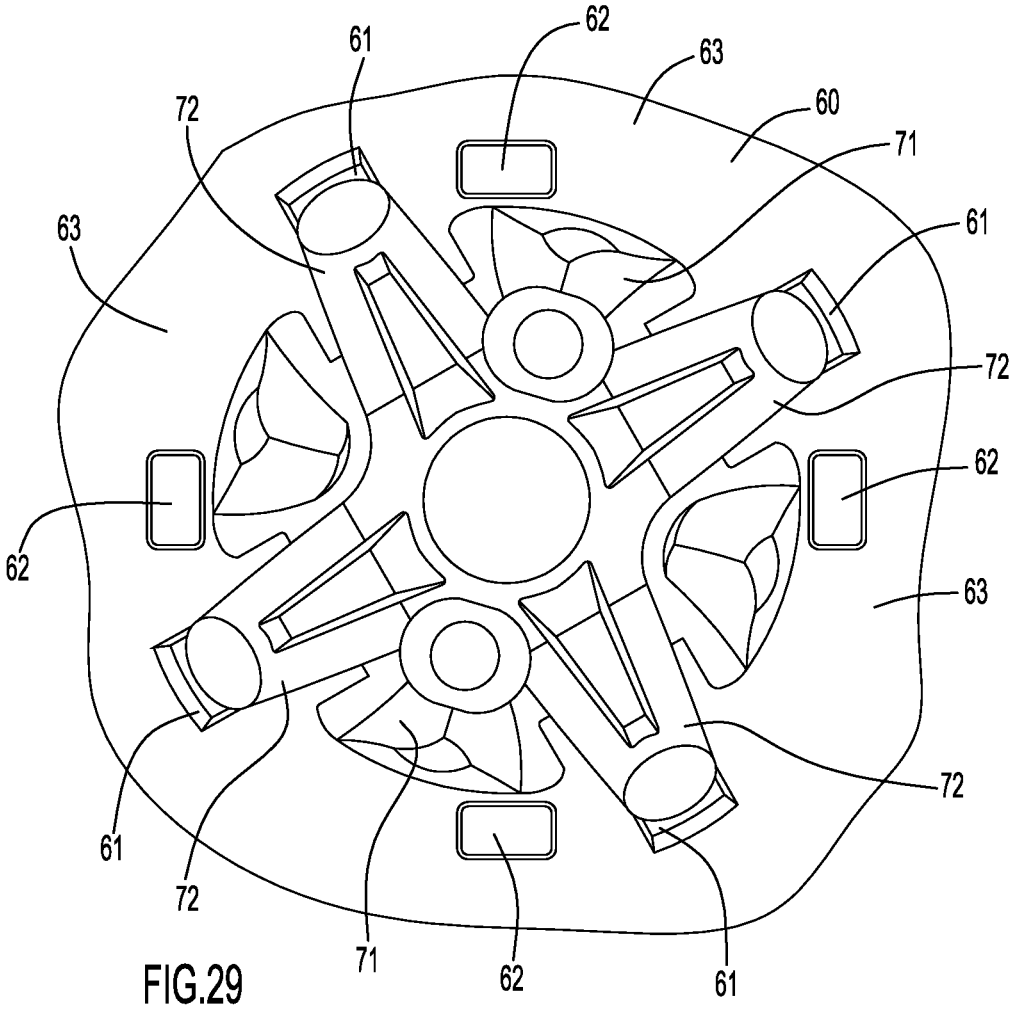
FIG. 29 is a view in plan similar to that of FIG. 25 but with the cleat rotationally positioned to permit maximum flexure of its dynamic traction elements.
Figure 30:
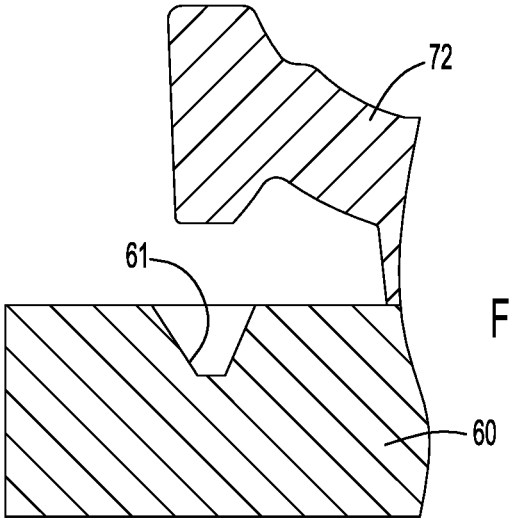
FIG. 30 is a diagrammatic view in section showing the dynamic traction element relative to the outsole for the cleat position illustrated in FIG. 29.

For the cleat position depicted in FIGS. 29 and 30 the dynamic traction elements 72 are angularly aligned with recesses 61 in each array. Vertical forces applied to the dynamic elements in this position are capable of causing maximum upward deflection, permitting traction head 73 to enter recess 61. In this position the "feel" is maximally soft, and there is a maximum dynamic component to the tractional effect.

It will be appreciated that by providing suitably positioned projections and recesses on the outsole, and using a multi-start thread, multiple levels of "feel" or traction can be selectively achieved. For the embodiment of FIGS. 25-30 the key to adjustability is the use of a multiple lead-in thread to provide different final positions of the cleat. It is possible to use any number of lead-in threads but there must be a different number of dynamic traction elements. For example, if there were three lead-in threads and three dynamic traction elements, there would be no effective difference between ending positions. For a multi-lead in of three and leg number of four or eight, there will be, by definition, different final orientations of traction elements.

As is noted from FIGS. 25, 27 and 29, the hub may be provided with cutout sections 64 aligned with dynamic traction elements 72 to permit additional space for flexure of the dynamic elements.

The preferred materials for the parts of the cleat are as follows:

The base portion is preferably a polymer such a polyurethane having a hardness or Durometer on the order of 55D to 65D (on the Shore D scale). The dynamic traction portion is preferably a polymer, also typically a polyurethane, having a hardness on the order of 82A to 90A (on the Shore A scale). The dynamic traction portion is the second shot in a two shot molding process used to manufacture the cleat and its material is partially wrapped around the harder material in the contours of the base portion and in recess areas and slots 28 to reduce abrasion of the softer material used for the dynamic traction elements. Adjustment ring 50 is preferably Nylon to impart more stiffness, particularly when compressed in its thickness dimension.

It will be appreciated that the embodiments described above and illustrated in the drawings represent only a few of the many ways of implementing the concepts of the present invention. For example, the cleat in the illustrated embodiment includes four static traction elements and four dynamic traction elements disposed symmetrically about the cleat axis. It will be understood that the number and types of traction elements and their orientation are not features of the invention other than the fact that the adjustable traction feature and the elongated dynamic traction element feature require at least one dynamic traction element. The other features of the invention apply irrespective of whether or not dynamic traction is utilized.

Adjustability need not be provided for all dynamic traction elements on a particular cleat, depending on the tractional characteristics desired. Accordingly, the number of projections 51 on adjustment ring 50 and the locations of the projections 51 on adjustment ring 50 can differ from the number and locations of dynamic elements on the cleat.

Likewise, in the topographical array of recess 61, structure 62 and space 63, the number of arrays need not track the number of dynamic traction elements, and the content of each array may be different.

The adjustment ring 50 is a particularly useful structure to provide adjustable traction according to the present invention. It is to be understood however that, within the principles of the invention, other ring configurations and even non-annular structures may be attached to the cleat in different positions to selectively restrict or not restrict deflections of the dynamic traction elements.

Although four dual locking posts are shown and described in the preferred embodiment, it is to be understood that the number of such posts is not a limiting feature of the invention.

The preferred embodiments described herein include a threaded stem on the cleat functioning in combination with a threaded receptacle to removably attach the cleat to a shoe sole. It will be understood that the particular attachment mechanism is not a limiting feature of the invention, and that a threaded engagement is only one example of the various ways in which the cleat can be secured in an outsole-mounted receptacle in either a single angular position or in selectively alternative positions. As one example, the non-threaded Q-Fit™ attachment mechanisms disclosed in U.S. Pat. No. 6,631,571 (McMullin '571) may be utilized, and the disclosure in that patent is incorporated herein by reference in its entirety. In that patent the disclosed cleat connector includes plural independent posts extending from the top surface of the cleat hub, each post having a retaining member at its distal end adapted to be received in a receptacle cavity through a respective contoured opening, after which the cleat is twisted into a locking position in the cavity. If the contours of the retaining members are different, and if the contours of the cavity openings are similarly different, specific initial and final angular positions of the cleat in the receptacle can be predetermined. Another example of an attachment mechanism that can be used is found in U.S. Pat. No. RE40,460 (Savoie '460), the entire disclosure of which is incorporated herein by reference.

Various features of the invention disclosed herein are mutually exclusive. For example, the adjustable traction feature does not require a two shot molding process for manufacture of the cleat, and does not require the dual locking post or any other locking arrangement. Likewise, the dual locking post feature is independent of traction adjustability and two-shot molding, and the two-shot molding feature is independent the dual locking post feature and adjustable traction.

Having described preferred embodiments of a new Improved Replaceable Traction Cleat For Footwear, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

We claim:

1. A traction cleat for use with an athletic shoe having a sole, said traction cleat comprising: a hub, a cleat connection member on a top surface of the hub and at least one traction element extending from a bottom surface of the hub, wherein the cleat connection member is configured to rotatably engage a receptacle connection member having an annular array of locking teeth, said receptacle connection member being secured in a said shoe sole, said traction cleat further including a locking structure comprising:

a plurality of dual locking posts extending from a the top surface of said hub in an annular array arranged to be disposed concentrically with said annular array of locking teeth, each dual locking post having a locking surface arranged to radially face said locking teeth and including:

first and second post sections joined by an angularly centered recess;

said post sections each including respective interior ramp segments that converge to form said recess, and said post sections each further including respective exterior ramp segments;

wherein the interior and exterior ramp segments of each post section converge to define an apex arranged to radially face said locking teeth;

wherein the dual locking posts are positionally arranged such that, during rotational engagement of the cleat connection member and the receptacle connection member, at least one of said locking teeth contacts and moves along the exterior ramp segment of at least one of said post sections and, upon passing an adjacent apex, moves into and is retained in the recess adjacent said at least one post section;

wherein said interior ramp segments have a steeper slope than said exterior ramp segments; and wherein said at least one traction element is at least one resiliently flexible dynamic traction element extending from said hub and arranged to resiliently flex in response of application of force thereto to determine, at least in part, the nature and amount of traction provided by the traction cleat; said traction cleat further comprising:

adjustment means for selectively adjusting the amount of flexure permitted for said at least one dynamic traction element.

2. The traction cleat of claim 1 wherein said adjustment means comprises an adjustment member movable between at least first and second positions, said adjustment member including a flexure impeding element configured and positioned to interfere with flexure of said at least one dynamic traction element in said first position but not in said second position.

3. The traction cleat according to claim 2 wherein said adjustment member is a ring configured to attach to said hub in said first and second positions, wherein said first and second positions are rotational positions relative to said hub, wherein said flexure impeding element is a projection from said ring, and wherein in said first position said projection is rotationally aligned with said at least one dynamic traction element.

4. The traction cleat according to claim 2 wherein said shoe sole includes at least two different topographical features on a bottom exposed surface of the shoe sole, wherein said adjustment means comprises means for selectively rotating said traction cleat between at least a first and a second predetermined orientation relative to said shoe sole, and wherein said at least one dynamic traction element is configured and positioned to be aligned with a different one of said topographical features in said first and second predetermined orientations.

5. The traction cleat according to claim 4 wherein at least one of said topographical features is a raised flexure impeding element projecting from the shoe sole and positioned to at least partially limit flexure of the at least one dynamic traction element in said first predetermined orientation of said traction cleat.

6. The traction cleat according to claim 5 wherein at least one of said topographical features is a recess in the shoe sole and positioned to enhance flexure of said at least one dynamic traction element when rotationally aligned with the recess.

7. The traction cleat of claim 1 wherein the traction cleat has a central axis about which the cleat connection member is rotated to engage the receptacle connection member, and wherein the central recess of each locking surface is a nadir angularly centered on that locking surface and disposed angularly symmetrical about an imaginary line extending radially from the traction cleat central axis through the nadir.

8. The traction cleat of claim 7 wherein the first and second post sections of each of said dual locking posts are configured and positioned in an angularly symmetrical manner about the central recess therebetween.

9. The traction cleat of claim 7 wherein said dual locking posts are four in number and are equally spaced angularly along said top surface of the hub.

10. The traction cleat of claim 7 wherein said dual locking posts are positioned at a radial location inboard of a periphery of the hub.

11. A traction cleat for use with an athletic shoe having a sole, said traction cleat comprising: a hub, a cleat connection member on a top surface of the hub and at least one traction element extending from a bottom surface of the hub, wherein the cleat connection member is configured to rotatably engage a receptacle connection member having an annular array of locking teeth, said receptacle connection member being secured in a said shoe sole, said traction cleat further including a locking structure comprising:

a plurality of dual locking posts extending from the top surface of said hub in an annular array arranged to be disposed concentrically with said annular array of locking teeth, each dual locking post having a locking surface arranged to radially face said locking teeth and including:

first and second post sections joined by an angularly centered recess;

said post sections each including respective interior ramp segments that converge to form said recess, and said post sections each further including respective exterior ramp segments;

wherein the interior and exterior ramp segments of each post section converge to define an apex arranged to radially face said locking teeth;

wherein the dual locking posts are positionally arranged such that, during rotational engagement of the cleat connection member and the receptacle connection member, at least one of said locking teeth contacts and moves along the exterior ramp segment of at least one of said post sections and, upon passing an adjacent apex, moves into and is retained in the recess adjacent said at least one post section;

wherein said interior ramp segments have a steeper slope than said exterior ramp segments; and wherein the first and second post sections of each of said dual locking posts are configured and positioned in an angularly symmetrical manner about the angularly centered recess therebetween.

* * * * *